United States Patent [19]

Byrne

[11] Patent Number: 4,959,021

[45] Date of Patent: Sep. 25, 1990

[54] PIVOTABLE POWER FEED CONNECTOR

[76] Inventor: Norman R. Byrne, 2736 Honey Creek, NE., Ada, Mich. 49301

[21] Appl. No.: 388,696

[22] Filed: Jul. 31, 1989

Related U.S. Application Data

[63] Continuation-in-part of Ser. No. 180,377, Apr. 12, 1988, abandoned, which is a continuation-in-part of Ser. No. 56,256, May 26, 1987, abandoned, which is a continuation of Ser. No. 826,198, Feb. 5, 1986, abandoned.

[51] Int. Cl.[5] ..... H01R 35/00

[52] U.S. Cl. ..... 439/310; 439/1; 439/137; 439/211

[58] Field of Search ..... 439/1, 11, 13, 134, 439/135, 137, 207–211, 310

[56] References Cited

U.S. PATENT DOCUMENTS

| | | | |
|---|---|---|---|
| 2,968,690 | 1/1961 | Higgins | 439/210 X |
| 4,241,965 | 12/1980 | Wilson | 439/207 X |
| 4,377,724 | 3/1983 | Wilson | 439/209 X |

*Primary Examiner*—Eugene F. Desmond

*Attorney, Agent, or Firm*—Varnum, Riddering, Schmidt & Howlett

[57] ABSTRACT

A pivotable power feed connector (100) is disclosed which includes a pivotal connector (116) adapted to be connected to a flexible conduit or cable (118) having a series of conductors (120) extending therethrough. The pivotal connector (116) is pivotably connected to a pivot block assembly (132) through which the conductors (120) extend. The pivot block assembly (132) is, in turn, connectable to a contact block (200) with the conductors (120) conductively connected to a set of prong terminals (212) extending outwardly from the contact block (200). A protective cover (228) is securable over the contact block (200) so as to prevent the prong terminals (212) from being exposed during assembly and disassembly. The cover (228) automatically exposes the prong terminals (212) as the power feed connector (100) is moved into engagement with an electrical receptacle (102) in a modular office panel (104). The pivotal connector (116) allows the conduit or cable (118) to be swiveled through an arc of approximately 180° to any desired position. The pivotal connector (116) is also manually removable from interconnection with the pivot block assembly (132). Such removal allows the conduit or cable (118) to be pulled back from the conductors (120) and cut to a desired length. The power feed connector (100) also includes a power feed cover (248) which can be utilized in part to maintain the pivotal connector (116) in either of two spatial configurations relative to the pivot block assembly (132).

35 Claims, 9 Drawing Sheets

PIVOTABLE POWER FEED CONNECTOR

RELATED APPLICATIONS

This is a continuation-in-part of application Ser. No. 07/180,377 filed Apr. 12, 1988 now abandoned, which was a continuation-in-part of application Ser. No. 07/056,256 filed May 26, 1987 now abandoned, which was a continuation of application Ser. No. 06/826,198 filed Feb. 5, 1986, and now abandoned.

TECHNICAL FIELD

The invention relates to electrical connector assemblies, and, more particularly, to assemblies for feeding utility power into electrical receptacles.

BACKGROUND ART

In various types of environments comprising electrical equipment or wherein electrical apparatus are otherwise employed, interconnections of electrical components to incoming utility power are typically provided by means of cables or wires. For example, in office systems comprising modular furniture components, it is often necessary to provide electrical interconnections between incoming power supplies and various types of electrical devices typically used in an office environment, such as electric typewriters, lamps, etc. Computer-related devices, such as video display terminals and similar peripherals, are also now commonly employed in various office and industrial environments.

One advantage inherent in modular office systems is the capability to rearrange furniture components as necessitated by changes in space requirements, resulting from chnnges in the number of personnel and other business-related considerations. However, these modular systems must not only allow for change in furniture configurations, but also must provide for convenient interconnection of electrical devices to utility power regardless of the spacial configuration of the modular systems and resultant variable distances between electrical devices.

In providing the interconnection of electrical apparatus and power inputs, it is necessary to include an arrangement for feeding the incoming utility power to the power outlets. In stationary structures such as conventional industrial buildings and the like, a substantial amount of room would normally exist behind stationary walls and other areas in which to provide the requisite cabling for interconnecting incoming utility power to electrical receptacles mounted in the walls. Such systems, however, could be designed so as to remain stationary throughout their lifetime, without requiring general changes in the office or industrial environment areas.

Systems such as those described above for stationary office building walls typically utilized rigid cables which would extend from utility power inputs to the rear portion of electrical receptacle boxes mounted in the walls. However, in electrical systems for use in environments such as modular office arrangements, there is often relatively little room for extending the cables between utility power inputs and electrical receptacles mounted in the modular wall panels. In addition, because of the capability of the modular systems to be arranged in various configurations, incoming power for one configuration may require a utility power cable extending into the electrical receptacle area from one direction, while other configurations would require the utility power input cable to extend toward the electrical receptacle area from another direction. In such event, different types of power feed connector arrangements would be required.

Still further, as modular office systems are rearranged and distances between electrical devices, receptacles and power inlets are varied, the lengths of interconnecting conduits or cables should preferably be adjusted. Otherwise, connector connections can be difficult to make, and extra (and relatively expensive) conduit or cable may be wasted. In addition, when cable connections are being assembled behind panel walls or the like, space may be severely limited.

Another problem associated with any type of connector arrangement associated with providing utility power to conventional power outlets relates to issues of safety. When utility power connections are to be made to power outlets, it is of substantial importance that the connections be properly made. For this reason, it is preferable to utilize power connection arrangements which, to the greatest extent possible, are configured in a manner so as to substantially prevent the electrician or other craftsperson from making an improper connection. Still further, a primary problem associated with the interconnection of utility power to electrical receptacles relates to the fact that the interconnection at the electrical receptacle may have terminals which are "live" with utility power. To the extent possible, it is therefore preferable to prevent the electrician from coming into contact with such live terminals.

Several types of contact devices are known for use with different types of electrical connectors. For example, Swiss Patent Document No. 648,698 describes a supply plug having a rotatable cable entry hood. The plug includes a cup-shaped molding having guides for three plug pins. An internal cap covers the pin terminals, and an outer shell has a cable anchor point and space for buckles of cable wires.

The internal cap includes a central turret having a central threaded bore. A screw connects the plug cable-shell to the turret, while allowing rotation of the shell by 270°in either direction. Holes in the cap allow the passage of the wires from the cable to the terminals. The lengths of the wires allow sufficient play to accommodate shell rotation.

In the U.S. patent to Lenkey 3,754,205 issued Aug. 21, 1973, a connector plug is disclosed having a hollow open-end housing. The open-end is closed by a single slidable sheath surrounding both contact blades of the plug. The sheath includes detents to engage a stop in the housing to retain the sheath and the housing. The sheath is slidable and spring-loaded so that pressure applied to the sheath will cause the sheath to extend inwardly into the housing so as to expose the contact blades.

In the U.S. patent to Wooten 4,445,739 issued May 1, 1984, two embodiments of an arrangement similar to the arrangement shown in the Lenkey patent are disclosed. A male plug arrangement includes a slidable sleeve normally enclosing the terminals, until the arrangement is pushed against a wall receptacle. When pressure is exerted toward a wall receptacle, the sleeve is retracted so that the terminal ends engage the receptacle. Both the Lenkey and Wooten patents also show embodiments whereby an adaptor can be utilized in conjunction with a standard male plug so as to provide a plug having shielded terminals.

The U.S. patent to Kreinsen 861,468 issued July 30, 1907 describes a contact device for electrical conduits which includes two oppositely arranged contact bolts, with funnel-shaped bores to receive concave-shaped heads of the bolts. A spring holds the contact bolts apart, and allows a plug to make a turning movement corresponding to that of an attached cable. It also permits the plug to be automatically released without damaging any part of the plug in the event that a violent "pull" occurs.

The U.S. patent to Gifford 2,239,846 issued Apr. 29, 1941 describes an electrical connection plug for connecting electrical appliances to floor, wall or ceiling receptacles. It includes an adapter plug for engaging the receptacle, with recesses communicating with the electrical conductors and a spring clamping member on the wire leading to the appliance. It further includes a pair of conductor heads adapted for insertion in the recesses of the adapter for making the connection with the conductors.

In the U.S. patent to Perbal 2,334,436 issued Nov. 16, 1943, a joint is disclosed for electrical fixtures. The joint is in the form of an elbow for connecting adjacent members of a bracket arm. The joint allows universal adjustability of one connected member relative to the other, and is constructed so as to offer frictional resistance to the relative adjustments of the bracket members. The joint is further constructed so as to provide adequate space within the joint for the relatively free extension of electrical conductors through the joint, while preventing any type of frictional rubbing action by the joint body.

The U.S. patent to Finizie 2,511,772 issued June 13, 1950 discloses an electrical connecting device having a pair of fixed engageable enclosed contact terminals. A handle is associated with the main body of the device, and includes a pivot member socketed and moveable within the body. Conductors extend through the handle member and strain-relief passages are provided in the pivot member. The conductors are connected to contact terminals by means of flexible coils located exterior and adjacent to ends of the pivot member and extending to the terminals.

In the U.S. patent to Ferguson 2,570,784 issued Oct. 9, 1951, an adjustable electric plug is disclosed whereby a male plug can be inserted into a conventional power outlet, and then rotated in a plane substantially perpendicular to the plug prongs, thereby reducing wear and tear on the plug and of the wires or cording enclosed. The plug includes a hollow cylindrical body portion, with a shank portion extending radially outward from the cylindrical portion. The shank portion includes a pair of cavities extending longitudinally which communicate with the hollow interior of the cylindrical portion. A rotor is provided within the cylindrical portion, and a pair of longitudinally-spaced annular grooves are provided in the periphery of the rotor. A pair of discs are fixed in the rotor with a periphery of one disc being exposed in each of the grooves. A pickup member is positioned in each of the cavities and extends into brushing engagement with one of the discs. The pickup members have U-shaped configurations and straddle the exposed peripheries of their respective discs. An electrical conductor is connected to the outer end of each of the pickup members, and a pair of prongs project from the rotor parallel to the axis of the rotor, with one prong being connected to each of the discs.

The U.S. patent to Teagno 3,601,746 issued Aug. 24, 1971 describes a two-part connector for making multiple connections to a printed circuit panel with one part mounted in trunnions, and with fork leaf contacts engaging tabs of the other part so that the two parts may be rotated in the manner of a hinge to vary the cable leadout angle. These two parts can be mated or disengaged over a wide range of relative orientation, so as to facilitate connections to spaced boards of a stack or in a low access phase.

The U.S. patent to Boutros et al, 4,432,592 issued Feb. 21, 1984 discloses an electrical connector having a protective hood, with strain-relief elements. The strain-relief elements include a pair of opposing clamping members displaced from an initial cable receiving position to a final cable clamping position. The displacement of the clamping members is effected automatically and simultaneously with assembly of the hood to the connector without the requirement of tools.

In the U.S. patent to Haworth et al, Reissue No. 31,733 reissued Nov. 13, 1984, a portable prefabricated panel is disclosed with a pre-wired power system. The panel includes electrical power blocks disposed adjacent to the opposite lower corners of the panel, with the power blocks connected by electrical cables which extend internally of the panel. When two or more panels are connected together, power is transmitted between each adjacent pair of panels by a flexible electrical connector which plugs into the power blocks of the adjacent connector. The panel includes electrical sockets integrally associated with the panel, with the sockets also associated with the power blocks. The blocks are symmetrical so that the same electrical connections can be made on either side of the panel. A channel-like raceway extends along the bottom edge of the panel for permitting the hidden storage of communication cables. The panel also includes a rectangular frame formed from hollow channel-like members which define an interior path around the complete periphery of the panel to facilitate the feeding of cables and conduits along the vertical or horizontal edges of the panel.

In the U.S. patent to Taylor 1,989,893 issued Feb. 5, 1935, an ignition cable is disclosed having a length of insulated wire, with the wire being of greater length than its insulation and extending beyond the end of the insulation. The extended portions are re-bent toward the opposite end of the wire and against the side of the insulation. A tip at the end of each cable includes an embracing skirt, a disc-shaped cap integral with the skirt, and a pair of annular depressions formed inwardly of the skirt and pressed into the insulation. A laterally extended and outwardly disposed resilient tongue is integral with the skirt between the annular depressions, and the re-bent portion of the wire bears against the cap and underlying one of the annular depressions.

In the U.S. patent to Millhimes et al, 4,593,960 issued June 10, 1986, a power entry connector is disclosed for bringing power to an electrical distribution system mounted in modular wall panels. The power entry connector includes a housing, with elements in the housing to retain contacts having tabs extending outwardly from the housing. A spring mounted cover is provided on the housing, to cover the tabs when the tabs are in a nonoperational state. The cover is slidably moveable to expose the tabs, for purposes of maintaining the tabs in an operational state.

Referring to FIG. 1, reference 10 indicates a power junction box comprising the major part of an electrical distribution system located along raceways adjacent to the lower edge of modular wall panels. The junction box 10 is adapted to receive duplex receptacles, such as the receptacle is, which is adapted to plug into recesses 20 located on each side of the junction box 10. The receptacles are energized by tabs 22 positioned on the receptacles. The tabs 22 enter into the box 10 through slots 24 and engaging sockets on the buss bars located within the junction box.

The electrical system is powered by current which enters from a floor mounted monument (not shown in the drawings of the patent), with the current entering the system through a power entry connector 26. The power entry connector 26 allows energizing or de-energizing of an electrical system within the modular wall panels, by plugging into or withdrawing the connection from a recess 20 within any given box 10.

Referring primarily to FIG. 2 of the patent, the power entry connector 26 includes a housing 28, back plate 30, front plate 32, cover 34, springs 36 and contacts 38.

Referring specifically to the housing 28, the housing 28 includes a back wall 48, side walls 50, 52 and end walls 54, 56. These walls are characterized within the patent as defining a front opening cavity 58. These elements are shown primarily in FIG. 2*a* of the patent. As also shown in this Figure, a hollow boss 60 is attached to and extends rearwardly from the back wall 48. With respect to FIG. 3, the patent shows a passage 62 which extends through the boss, and provides access to the cavity 58 for the wires 40 of the connector. The arrangement also includes various elements associated with the boss 60 which allows a conduit 44 to be secured to the housing.

With respect to the side walls 50, 52 of the housing 28, a latch 70 is provided on each of the walls. The latches are hinged at one end and are resiliently removable in an arc perpendicular to the plane of the side walls. Each latch includes a hook 72 which faces into the cavity 58. One of the latches is adjacent an end wall 56, while the other latch on the opposite wall is adjacent an opposing end wall 54.

The arrangement also includes a safety stop member 74 which is carried on the side wall 50 adjacent to latch 70. The stop member 74 includes a forwardly facing shoulder 76. In addition, a stability "finger" 77 is located on the free edges of top wall 50 and bottom wall 52.

The arrangement also includes two blocks 78, positioned on each end wall 54, 56, to provide shoulders so as to receive latches 80 located within the recesses 20 on the junction boxes. A third block, indicated by reference 82, provides a fulcrum for purposes of utilizing a tool to release the latch 80. An ear 84 is also positioned on each end wall. The holes through the ears receive screws 85 so as to securely attach the connector 26 to the junction box 10.

Each of the end walls 56 includes a pair of retaining elements 86 which are located adjacent the free edge of each of the walls, and which bracket a finger 88 projecting forwardly from the free edge. An end wall 54 carries a single retaining element 86 which is located adjacent the free edge and above finger 88 located on the edge of the wall. In addition, stop elements 90 are provided on the inside surfaces of each side and end wall. Further, a pair of parallel channels 92, 94 are cut into the inside surface of side wall 50. In addition, a single channel 96 is cut into the inside surface of the side wall 52.

The back plate 30 is illustrated in FIGS. 2, 4 and 5. As shown in FIG. 2, a number of openings extend through the plate 30. Two of the openings are indicated by reference 104, and are counter-bored so as to provide a spring receiving section opening into the front face, with a smaller, pin receiving section opening into the back face. These two openings are located near a diagonally-opposite openings of the plate. A second set of openings, indicated by 106, are also counter-bored in a similar manner.

Two contact passages 108, 110 are located on one side of the plate. The two passages are displaced vertically and horizontally relative to each other. In addition, an additional two contact passages are located toward the other side of the plate. These two passages are positioned one over the other. Each of the four passages includes slot sets along two opposing walls. Each set includes two slots on the same plane and with each slot being in an opposing wall. One set, identified in the patent by numeral 116, extends through the passage. A second set, indicated by numeral 118 in FIG. 4, extends a short distance back into the passage from the plate's front face. The slots are also shown in FIG. 2, with the short or second slots 118 being above the first set of slots 116 and passages 108, 110, and below the first set of passages 112, 114. In addition to the contact passages, two contact channels 120, 122 are positioned on the upper edge of the plate 30. An additional contact channel 124 is positioned on the bottom edge, directly below the passages 112, 114. When the plate 30 is positioned within the housing 28, these channels cooperate with channels 92, 94 and 96 so as to form contact passages.

The back face 102 of the plate 3 is primarily shown in FIG. 2*a*. Rearwardly projecting walls, indicated by numeral 126, extend the length of the aforedescribed passages and channels, beyond the back face. Rearwardly projecting bars 128 are located around the periphery of the plate, so as to meet the stop elements 90 when the plate 30 is positioned within the housing 28.

The front face 130 of the plate 32 is primarily shown in FIG. 2, with sectional views also shown in FIGS. 3, 6 and 7. A pair of openings 132, located near diagonally opposite corners of the plate 32, extend therethrough. Slits 134 extend through the plate and are positioned to be in line with the slots 118 in the passages in plate 30 when the two plates are positioned together in housing 28. Correspondingly, notches 136, 138 are provided in one edge of the plate near one corner. A single notch 140 is provided in the opposite edge of the plate near a diagonally opposite corner. These notches are in line with channels 120, 122 and 124, respectively, in plate 30 when the two plates are positioned together. A recess 142 is also provided in each of the two elongated edges of the plate.

The cover 34 is primarily shown in FIGS. 1 and 2, and also sectionally illustrated in FIGS. 3, 6 and 7. The cover 34 includes a front wall 144, side walls 146, 148 and end walls 150, 152. A series of slits 156 extend through the front wall and into a cavity 154 formed by the five walls of the cover 34. The slits are in registration with the slits 134, and with notches 136, 140 when the power entry connector is assembled. An additional slit 157, adjacent one of the slits 156 and located next to the side wall 146, is in registration with the notch 138 and channel 122.

Referring to one end of the cover 34, a pair of slits 158 are provided. An additional slit 158 is also provided on the opposite end of the cover. The slits comprise core pin access openings for the purpose cf providing grooves 160 along inside surfaces of the end walls, and a forwardly facing shoulder 162.

In addition to the slits 158, additional slits 164 of somewhat greater width are also provided in the front wall. These slits receive fingers 88 in the housing 28, when the connector is assembled and plugged into the recess 20 within the box 10. Additional slits 165 are also provided in the front wall adjacent side walls 146, 148 so as to receive stabilizing fingers 77. A cutout 166 is also provided in each of the end walls 150, 152.

The arrangement also includes a series of contacts 38 which are stamped and formed from a conductive material. Each of the contacts includes a tab 170. The contacts include "hot", "neutral" , and "ground" wire interconnections. Each of the contacts also includes a pair of laterally projecting ears 176.

The assembly of the power entry connector 26 is primarily illustrated in FIGS. 2 and 3. Specifically, a threaded stud 68 is positioned within the cavity 58 of the housing 28. The conduit connector 44 is secured to the housing 28 with a lock ring 46 threaded onto the stud 68. The contacts 38 are then interconnected with the wires 40 and threaded through the conduit connector and housing 28.

The contacts are then threaded through the appropriate passages and channels within the plate 30. These contacts are passed through various aforedescribed passages, and the back face of the plate 32 is abutted against the front face 100 of the plate 30. Snap pins on the plate 32 are forced through openings 106 for temporarily retaining the contacts between the plates.

With the plates 30 and 32 positioned together, they are then positioned within the housing 28. As the two plates are moved into the cavity 58, the latches 70 are biased until the plate 32 passes behind the hook 72. The latches 70 then snap back to bring the hook in front of the plate 32 and into the recesses 142. In this manner, the latches removably lock the two plates within the housing 28 as primarily shown in FIGS. 6 and 7.

The cover 34 is then added for purposes of completing the assembly. Specifically, the coil springs 36 are located on the pins 168 (as shown in FIG. 6). The sidewalls 146, 148 and end walls 150, 152 slide over the side Walls 50, 52 and end walls 54, 56 of the housing 28. The end walls 150, 152 bow slightly in passing over the retaining elements 86 until the elements 86 enter the grooves 160. The retaining elements, in cooperation with the shoulders 162 defined by the grooves, removally retain the cover on the housing as primarily shown in FIGS. 1, 6 and 7. In this manner, the cover 34 can then be moved back and forth on the housing for the length of the grooves.

The pins 168 slide through the openings 132 and 104. The coil springs 36 are located within the openings 132 and sections 104. The forwardly facing shoulder defined by the counter bores in openings 104 and the inside surface of front wall 144 of the cover capture the coil springs therebetween.

The connector arrangement, without the cable conduit 44 and four of the six wires 40 and associated contacts, is shown in a sectional manner in FIG. 6 in a non-functioning state. That is, the springs 36 urge the cover 34 forwardly away from the housing 28 so that the tabs 170 are isolated by the cover. In this manner, two safety features are provided. Specifically, the stop member 74 is configured so that the cover 34 abuts the shoulder 76, and cannot be moved further rearwardly until the member 74 is depressed. The second safety feature includes cutouts 166. The cutouts 166 provide a recess for blocks 78 as the cover moves back on the housing 28. With the cover in its forwardly extending position as primarily shown in FIG. 1, the cutout space provides an access into the cover cavity 154 and contact tabs 170, except for the forwardly extending fingers 88. These fingers 88 block such an access.

FIG. 7 is a sectional view similar in configuration to FIG. 6. However, in FIG. 7, the connector 26 is shown as if plugged into the recess 20 within the box 10. The connector 26 moves into the recess 20 until the cover 34 encounters a back wall to recess. At that point, assuming that the stop member 74 is depressed, the rest of the connect continues to move forward. The tabs 170 pass through slits 156 and into sockets on the buss bars within the box by means of slots 24. The coil springs 36 are compressed and the free ends of the pins 168 enter the cavity 58 of the housing 28 by means of openings 104. When the connector 26 is fully moved into the recess, the latches 80 are "caught" on the block 78 so as to releasably lock the connector to the box. The connector is then made more secure against an inadvertent withdrawal by securing self-tapping screws 85 into the box 10 through holes in ears 84 in the housing. The holes 178 are provided on the box to receive the screws.

The connector 26 can be released from the junction box 10 by removing the aforementioned screws and prying back the latches 80. For this function, a screwdriver tip or similar tool can be inserted against the latch, and the block 82 utilized as a fulcrum. In this manner, the latch is "pried" off the block 78. Although the Millhimes et al arrangement provides a power entry connection assembly, the arrangement does not appear to provide any facilitation of adjustment of the cable conduit position relative to the power connector and junction box.

SUMMARY OF THE INVENTION

In accordance with the invention, a power feed assembly is adapted to supply electrical power and/or ground voltages to an electrical receptacle means. The receptacle means is correspondingly adapted to be located in a wall panel, support surface or the like, and connectable to various types of electrical apparatus or to other receptacle means. The power feed assembly includes pivotal connector means adapted to be secured to a conduit or cable having at least one conductor capable of carrying electrical power or ground voltage prior to any electrical connection to the electrical receptacle means. Pivot block means are pivotably connectable to the pivotal connector means so as to provide a pivot connection relative to the conduit or cable.

The assembly also includes contact block means connectable to the pivot block means and having at least one prong terminal electrically connectable to the conductor. Protective cover means are adapted to be slidably secured to the contact block means to selectively cover the prong terminal. The assembly also includes means for selectively locking the pivotal connector means in a fixed position relative to the pivot block means.

The pivotal connector means includes first pivot means to pivotably connect the pivotal connector means to the pivot block means. The pivot block means includes second pivot means connectable to the first pivot means to pivotably connect the pivot block means to the pivotable connector means. The first pivot means is interconnectable with the second pivot means in a manner so as to allow the conduit or cable to freely swivel throughout a range of at least approximately 180° relative to the pivot block means. The first pivot means can include one pair of trunnions, and the second pivot means can include at least one pair of connecting standards. Each of the standards includes means to pivotably receive one of the trunnions.

The pivotal connector means can also be characterized as having first interconnection means to removably interconnect the pivotal connector means with the pivot block means. Correspondingly, the pivot block means can be characterized as comprising second interconnection means removably connectable to the pivotal connector means to removably interconnect the pivot block means to the pivotal connector means. The conduit or cable is secured to the pivotal connector means and the first interconnection means is interconnectable with the second interconnection means in a manner so that the pivotal connector means is manually removable from the pivot block means independent of requiring the use of tools or the like. The conduit or cable can thus be pulled back from the pivot block means independent of and relative to the conductor for purposes of modifying the length of the conduit or cable.

The first interconnection means can be removably snap-fitted into the second interconnection means, and can include a pair of flanges, with each of the flanges having a trunnion mounted thereon. Correspondingly, the second interconnection means can include a pair of connecting standards, with each of the standards having a trunnion hole and an opening extending outwardly from the hole. Each of the trunnions can then be snap-fitted into and manually removed from a corresponding trunnion hole through a corresponding opening.

The power feed assembly also includes latching means associated with the contact block means and the protective cover means. The latching means is adapted to removably latch the protective cover means in a first position relative to the contact block means as the protective cover means is first slidably engaged onto the contact block means. In this manner, the protective cover means shields the prong terminal when the cover means is in the first position. The latching means can include a plurality of recesses located in the contact block means and opening laterally outwardly therefrom. The latching means can also include slot means located in the protective cover means, and resilient plug means resiliently positioned in the plurality of recesses. The resilient plug means is adapted to engage the slot means as the protective cover means is slidably received onto the contact block means.

The slot means can include a plurality of T-shaped slots, with each of the slots having a first slot and an elongated second slot perpendicular to the first slot. The resilient plug means can include a plurality of latch plugs corresponding in number to the number of slots. The latch plugs can be adapted to lockably engage the first slots of the T-shaped slots when the protective cover means is in the first position. The latch plugs can also be adapted to slidably engage the second slots of the T-shaped slots when the protective cover means is in the second position.

The latch plugs can be resiliently positioned in the recesses so that when the latch plugs are engaged with the first slots of the T-shaped slots, the protective cover means is in the first position and all of the latch plugs must be simultaneously compressed toward the recesses so as to disengage the protective cover means from the first position and move the same toward the second position. The latch plug means can also include spring means for resiliently urging outwardly each of the latch plugs from the recesses.

Each of the latch plugs can include a stepped end having outer ledges adapted to abut side walls adjacent the first slots of the T-shaped slots when the protective cover means is in the first position. Intermediate ledges are adapted to abut side walls adjacent the second slots of the T-shaped slots when the protective cover means is in the second position. Each latch plug also includes a terminating end extending outwardly between the intermediate ledges. Each terminating end is adapted to be received in a second slot of each T-shaped slot when the protective cover means is moved from the first position to the second position. The terminating end of each latch plug can be beveled so as to cause each plug to compress inwardly toward its corresponding recess when the protective cover means engages the receptacle means.

The latching means can be configured so as to automatically unlatch the protective cover means from the first position as the power feed assembly physically engages the electrical receptacle means. The latching means can also allow the protective cover means to move to a second position relative to the contact block means, whereby the prong terminal is exposed and electrically connectable to the receptacle means. The assembly can also include resilient means disposed between the contact block means and the protective cover means to exert forces on the protective cover means tending to urge the protective cover means toward the first position.

The contact block means can include locking wedge means to removably lock the power feed assembly into the receptacle means. The receptacle means can include retainer means to removably retain the power feed assembly within the receptacle means. The pivot block means can include lock tab means engageable with the receptacle means to removably lock the power feed assembly into the receptacle means. Correspondingly, the electrical receptacle means can include cavities adapted to receive the lock tab means to removably lock the assembly into the receptacle means.

The retainer means of the electrical receptacle means can have a shape and resiliency so as to flex sufficiently to allow the locking wedge means to pass by the retainer means as the power feed assembly engages the receptacle means. The retainer means can also have a shape so as to prevent outward movement of the power feed assembly from the receptacle means in the absence of any manual flexure of the retainer means.

The locking wedge means can include a pair of wedgeshaped tabs having a lower beveled face. Correspondingly, the retainer means can include a pair of spring tabs, with each tab having a resilient elongated portion terminating in a retainer lip having an upper beveled face. The pivot block means can include a pair of lock tabs pivotable relative to the pivot block means, with the receptacle means having a pair of cavities formed between side walls of the receptacle means and the retainer means, so that each of the cavities is adapted to receive one of the lock tabs.

The pivotal connector means can include a main portion through which the conductor is extended. In addition, the pivotal connector means can also include extending flanges connected to outer sides of the main portion. Means are associated with each of the flanges to allow pivotable movement of the pivotal connector means relative to other elements of the power feed assembly. In addition, a pair of bores extend through the main portion.

The pivot block means can include a flat rectangular portion having downwardly-extending edges at the periphery thereof. A pair of connector standards extends upwardly from the rectangular portion. Means are associated with each connector standard to receive trunnions of the pivotal connector means to accord pivotable movement of the connector means relative to the pivot block means.

The contact block means can include a set of metallic prong terminals extending downwardly from an underside portion of the contact block means. The contact block means can also include a series of recesses located in side walls of the contact block means. Further, a pair of locking wedges can extend outwardly from opposing end walls of the contact block means.

The protective cover means can include a flat rectangular portion having a pair of upwardly-extending opposing side portions and a pair of upwardly-extending opposing end portions. A series of prong terminal slots are located in the flat rectangular portion, and a series of T-shaped slots are located in the side portions of the protective cover means.

The power feed assembly can also include key means located on the protective cover means. The key means can be adapted so as to ensure that the power feed assembly can engage the electrical receptacle means only in one spatial configuration.

BRIEF DESCRIPTION OF THE DRAWINGS

The invention will now be described with reference to the drawings in which.

DETAILED DESCRIPTION

The principles of the invention are disclosed, by way of example, in a pivotable power feed connector 100 as depicted in FIGS. 1-13. The pivotable power feed connector 100 is adapted for use to provide utility power to one or more electrical receptacles, junction boxes or similar arrangements, wherein power can then be fed to conventional electrical apparatus. The power feed connector 100 provides an arrangement whereby cabling can extend from the main body of the power feed connector 100 in selective directions, and assembly and disassembly of the power feed connector 100 from the electrical receptacle junctions can be made in a convenient and, in particular, safe manner.

Figure 1:
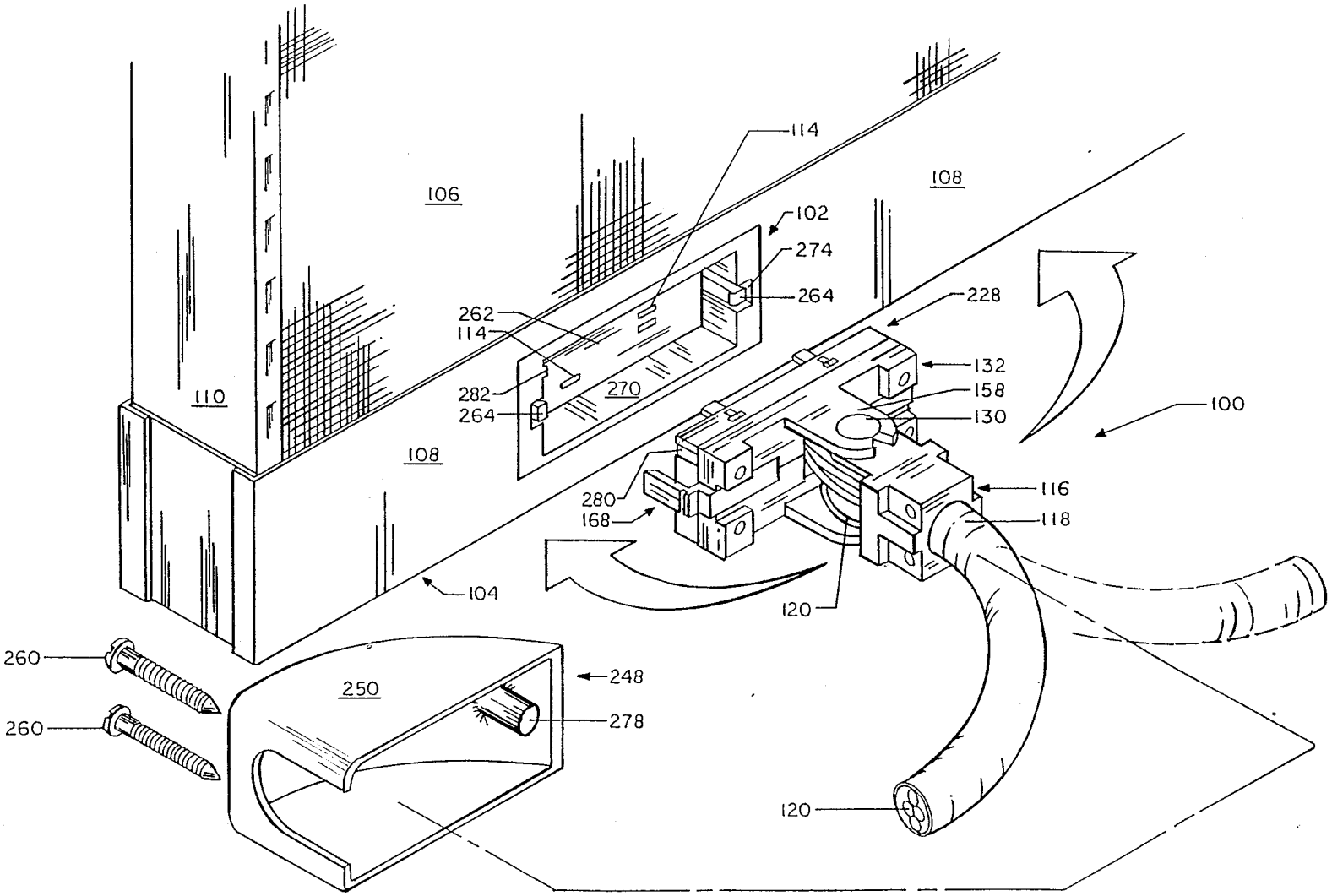
FIG. 1 is a perspective view of one embodiment of a pivotable power feed connector in accordance with the invention, and further showing a partial perspective view of a portion of a modular office panel having a connector receptacle area in which the pivotable power feed connector can be engaged.

With reference specifically to FIG. 1, the pivotable power feed connector 100 is adapted to engage other electrical apparatus such as a connector receptacle and junction box 102. The connector receptacle 102 can be mounted in a wall or similar support structure such as the modular panel !04 shown in partial section in FIG. 1. The modular panel 104 can be a conventional modular office wall panel or the like, having a rear side 106, panel end 110 and lower rear side back panel 108. The depth of the modular panel 104 can be of various dimensions. The portion of the rear side 106 above the back panel 108 can be covered with a fabric or other cover of similar composition.

The connector receptacle 102 is located in the rear back panel base 108 as further shown in FIG. 1. The receptacle 102 includes a block 112 having electrical outlets (not shown) projecting toward the front portion of the modular panel 104 for purposes of interconnecting various electrical apparatus. These electrical outlets on the front of the panel 104 can be energized by the insertion of live electrical terminals from the pivotable power feed connector 100 into the receptacle terminal slots 114. In addition to the connector receptacle 102, various other types of connector receptacles can be utilized with a pivotable power feed connector in accordance with the invention. The connector receptacle 102 is commercially available and relatively conventional in structure. However, certain specific structural elements associated with the receptacle 102 are advantageous to interconnection of the power feed connector 100 in accordance with the invention. These elements will be described in subsequent paragraphs herein.

Although not shown in the drawings and not forming the basis for any principal concepts of the invention, the connector receptacle 102 can include elements such as side connectors which can be utilized with other cabling for purposes of energizing one or more additional connector receptacles in the modular panel 104. As will be described in greater detail herein, the pivotable power feed connector 100 is also adapted for use with modular panels of varying depths. In addition, it should be emphasized that the power feed connector 100 in accordance with the invention can be utilized with other types of walls or office structures.

Figure 2:
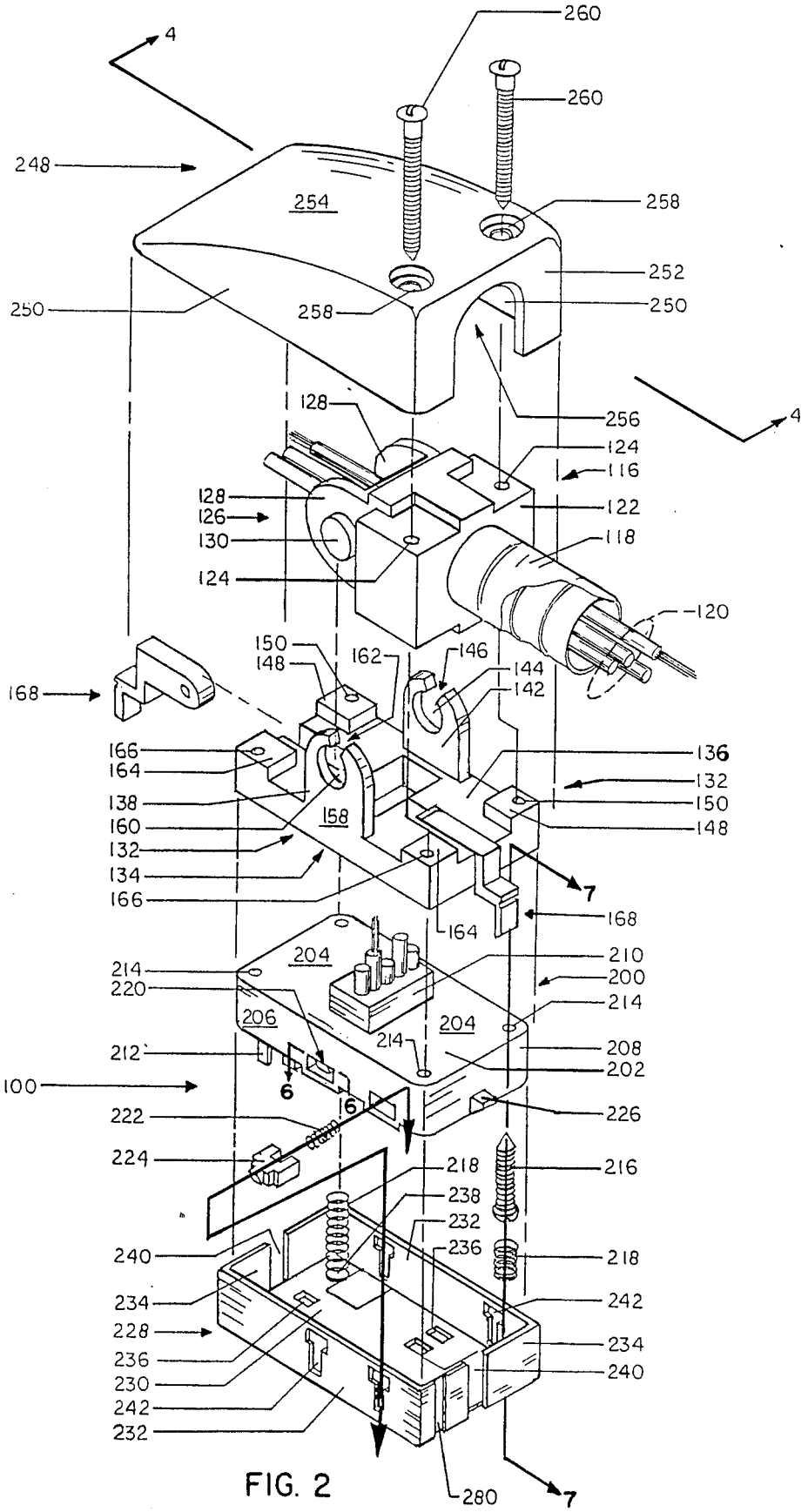
FIG. 2 is an exploded perspective vies of the pivotable power feed connector shown in FIG. 1 in accordance with the invention, but excluding in part the cable interconnection within the connector.
Figure 9:
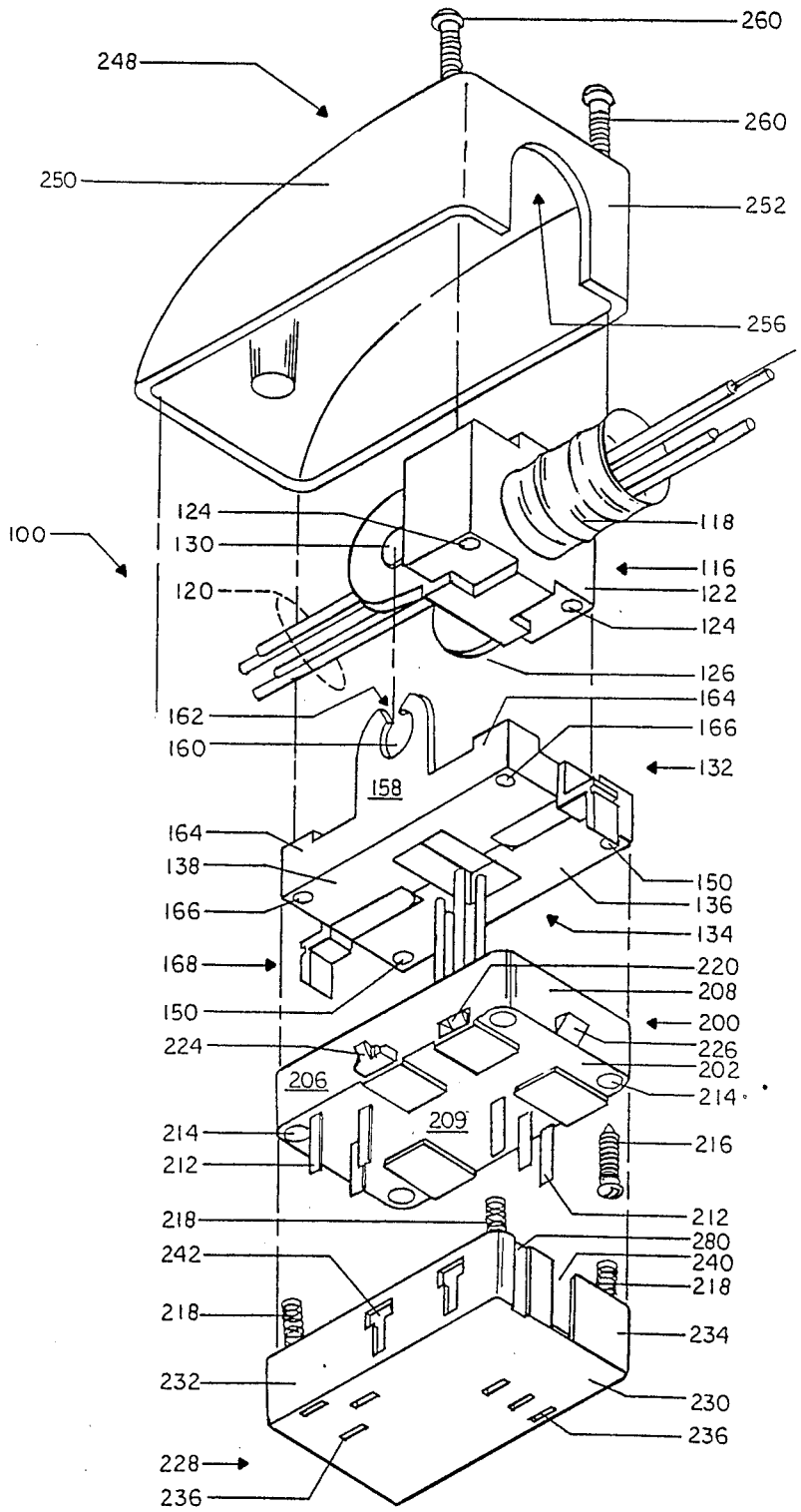
FIG. 9 is an exploded view of the pivotable power feed connector shown in FIG. 1, the view being similar to the view of FIG. 2, but showing the underside portions of the elements of the power feed connector.

The pivotable power feed connector 100 in accordance with the invention will now be described in detail, primarily with respect to the exploded views of FIGS. 2 and 9, and the partial views of FIGS. 3–7. As shown in FIGS. 2 and 9, the power feed connector 100 includes a pivotal connector 116 secured by any suitable means (not shown) to a conduit or similar cable 118. The conduit or cable 118 is preferably flexible and can be any one of numerous conventional cables. The conduit or cable 118 is typically connected to incoming utility power.

Running through the flexible cable or conduit 118 are a series of conductors 120, each typically carrying utility power and/or ground voltages. The conductors 120 will carry the actual power to be applied to the electrical receptacles within the modular panel 104.

Figure 8:
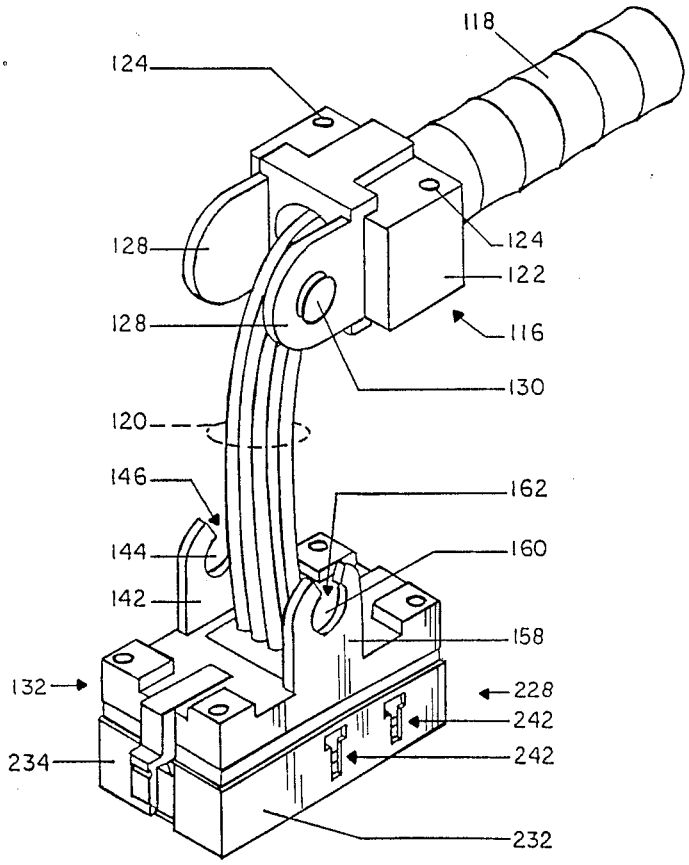
FIG. 8 is a perspective view of the pivotable power feed connector shown in FIG. 1 in accordance with the invention, and further showing the pivotal connector disengaged from the pivot block assembly for purposes of adjusting the conduit length.

The pivotal connector 116 includes a main body portion 122 through which the series of conductors 120 extend. The main body portion 122 is substantially rectangular in shape and includes pair of bores 124 extending therethrough. Integral with or otherwise connected to one side of the main body portion 122 opposing the side of the main body portion to which the conduit 118 is connected is a yoke-like structure 126 comprising a pair of parallel extending flanges 128 having a semi-circular configuration as primarily shown in FIGS. 2 and 8. Each of the extending flanges 128 includes a laterally projecting trunnion 130 in the form of a cylindrical projection. Only one of the trunnions 130 is shown in FIGS. 2, 9 and 8. As subsequently described in greater detail herein, the flanges 128 and trunnions 130 comprise a means for allowing pivotal movement of the pivotal connector 116 relative to other elements of the power feed connector 100. In addition, as also described subsequently herein, the interconnection of the flanges 128 and trunnions 130 to other elements of the connector 100 provide a means for disengagement of the connector 116 from the other power feed connector elements so as to adjust the length of the conduit 118.

Figure 5:
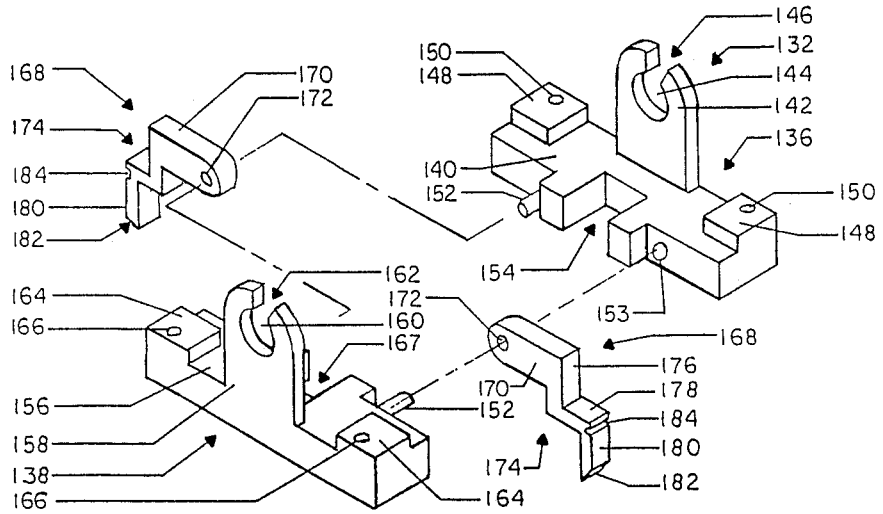
FIG. 5 is an exploded view of an exemplary pivot block assembly of the pivotable power feed connector shown in FIG. 1 in accordance with the invention.

The power feed connector 100 also includes a pivot block assembly 132 as shown primarily in FIGS. 2, 9 and 5. The pivot block assembly 132 includes a central body section 134 (FIG. 2) having a substantially rectangular configuration and formed by a pair of substantially equivalent components designated in FIG. 5 as a first half section 136 and a second half section 138. Referring specifically to FIG. 5, the first half section 136 includes a substantially flat rectangular portion 140 having a connecting standard 142 projecting upwardly (as shown in FIG. 5) from the central area of the rectangular portion 140 along one edge thereof. The connecting standard 142 includes a circular trunnion slot 144 having a flared opening 146 projecting upwardly therefrom. In addition, the first half section 136 also includes a pair of rectangular ledges 148 integral with or otherwise connected to the rectangular portion 140 and projecting upwardly therefrom at opposing ends of the rectangular portion 140. Each of the ledges 148 includes a bore 150 extending completely or partially through the corresponding ledge 148 and the rectangular portion 140.

In addition to the foregoing, the first half section 136 also includes a pintle 152 as further shown in FIG. 5. The pintle 152 is integral with or otherwise secured to an inwardly directed wall of the first half section 136, and is positioned on one side of a recess 154 formed along one side of the central area of the rectangular portion 140. Correspondingly, the first half section **13*b* also includes a pintle hole 153 positioned on the same inwardly directed wall as the pintle 152, but further positioned on an opposing side of the recess 154**.

The second half section 138 is substantially similar to the previously described first half section 136. That is, the second half section 138 also includes a rectangular portion 156, with a connecting standard 158 projecting upwardly from the rectangular portion 156 at a central area along one side thereof. The connecting standard 158 includes a trunnion slot 160 having a circular configuration and opening upwardly into a flared opening 162. In addition, the second half section 138 also includes a pair of rectangular ledges 164 integral with or otherwise connected to an upper surface of the rectangular portion 156 at opposing ends thereof. Each of the ledges 164 includes a bore 166 extending completely or partially through the corresponding ledge 164 and the rectangular portion 156.

Still further, the second half section 138 also includes a pintle 152 (partially shown in FIG. 5) integral with or otherwise secured to an inwardly directed wall of the half section 138. For assembly purposes described subsequently herein, the pintle 152 on the second half section 138 is preferably positioned on one side of a recess 167 formed along one side of the central area of the rectangular portion 156, and is preferably in alignment with the pintle hole 153 on the first half section 136. In addition, the second half section 138 further includes a pintle hole (not shown) preferably positioned on the same inwardly directed wall as the pintle 152, but further positioned on an opposing side of the recess 167.

In addition to the first and second half sections 136, 138, respectfully, the pivot block assembly 132 also includes a pair of lock tabs 168 as shown primarily in FIGS. 2 and 5. With reference specifically to FIG. 5, each of the lock tabs 168 includes an inwardly projecting arm 170 having a rounded distal end with a bore 172 extending transversely through the arm 170. The projecting arm 170 has its opposing end integral with or otherwise connected to a finger portion 174. The finger portion 174 of each of the lock tabs 168 includes a first extension 176 projecting at a right angle to the relatively long axis of the projecting arm 170. A second extension 178 is integral with a corresponding one of the first sections 176 and extends outwardly at right angles thereto. A further third extension 180 projects downwardly at a right angle to the corresponding second extension 178. Still further, a slot 184 extends transversely across the upper portion of the third extension 180 adjacent the integral interconnection with the second extension 178. The purposes of the slot 184 will be described in subsequent paragraphs herein.

The pivot block assembly 132 is assembled by mating the substantially identical first half section 136 and second hal section 138 together, with the pintle 152 secured to the first half section 136 engaging a corresponding hole (not shown) on the inner wall of the rectangular portion 156 of the second half section 138. Similarly, the pintle 152 integral with or otherwise secured to the second half section 138 engages the corresponding pintle hole 153 on the inner wall of the rectangular portion 140 of the first half section 136. Each of the lock tabs 168 is pivotally connected to the first and second half sections 136, 138 by receiving a corresponding one of the pintles 152 through the bore 172 in the projecting arm 170 of the corresponding lock tab 168. The relative dimensions of the bores 172 and the pintles 152 is such that each of the lock tabs 168 can freely pivot about the longitudinal axis of the corresponding pintle 152. The particular functions of the lock tabs 168 will be described in subsequent paragraphs herein. It should be noted that the exemplary pivot block assembly 132 shown in FIG. 5 includes a pintle 152 and pintle hole 153 associated with each of the first and second half sections 136, 138. However, different configurations could be employed. For example, both pintles 152 could be positioned on the same half section 136 or 138, with the pintle holes 153 positioned on the other half section 138 or 136, respectively. Still further, however, with the pintle and pintle hole arrangement shown in FIG. 5, each of the half sections 136, 138 is identical to the other half section. Accordingly, for purposes of reducing the relative costs of manufacture, a single mold could be employed to manufacture both half sections 136, 138.

The pivot block assembly 132 is shown as primarily assembled in FIGS. 2 and 9. With this assembly, the recess 154 of the first half section 136 and the recess 167 of the second half section 138 form a slot 186 through which the series of conductors 120 extend after complete assembly of the pivot power feed connector 100.

As further shown primarily in FIGS. 2 and 9, the pivotable power feed connector 100 also includes a contact block 200. Referring specifically to FIGS. 2 and 9, the contact block 200 includes a rectangular slab 202 constructed of a highly insulative material. The rectangular slab 202 includes an upper surface 204, side walls 206 (only one of which is shown in FIG. 2) and opposing end walls 208 (only one of the end walls 208 shown in FIG. 2). In addition, as shown in FIG. 9, the slab 202 also includes a bottom surface 209. The conductors 120 are received within a rectangular boss 210 integral with or otherwise mounted to the upper surface 204 of the contact block 200. When the contact block 200 is appropriately interconnected with the pivot block assembly 132, the rectangular boss 210 extends upwardly into the cavity 186 of the pivot assembly 132.

The rectangular boss 210 can comprise a terminal connector block having a series of terminal connectors (not shown) conductively connected to individual ones of a series of metallic prong terminals 212 extending downwardly from the bottom surface 209 of the contact block 200. Within the contact block 200, the metallic prong terminals 212 are selectively connected to various ones of the conductors 120. The actual connection of the series of conductors 120 to the prong terminals 212 can be made by any of various connection arrangements, including the molding of the conductors 120 into the rectangular boss 210 mounted on the upper surface 204 of the contact block 200.

Figure 7:
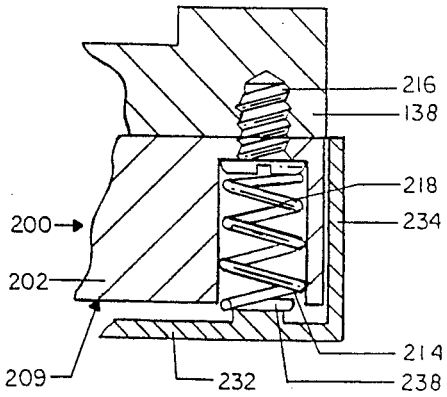
FIG. 7 is a partial sectional view of a screw and spring arrangement for interconnecting the pivot block assembly and contact block of the pivotable power feed connector shown in FIG. 1 in accordance with the invention, taken along section lines 7—7 of FIG. 2.

The contact block 200 further includes a series of holes 214 located at individual corners of the rectangular slab 202 and extending vertically therethrough. As shown in FIG. 7, each of the holes 214 can be counter-bored from the bottom surface 209 of the rectangular slab 202 of contact block 200. To interconnect the pivot block assembly 132 with the contact block 200, screws 216 can be employed. The counter-bored holes 214 in the contact block 200 may be partially threaded or, alternatively, may be unthreaded, with the screws 216 slidably fitting through the counter-bored holes 214. The bores 166 and 150 in the pivot block assembly 132 are aligned with the holes 214 when the pivot block assembly 132 is mounted on the upper surface 204 of the contact block 200. With this mounting, the rectangular boss 210 is received within the cavity 186 of the pivot block assembly 132. For purposes described in subsequent paragraphs herein, the holes 214 are preferably counter-bored so as to allow sufficient room for a series of coil springs 218, with each of the coil springs 218 having one end engaging the head of a corresponding one of the screws 216.

If the screws 216 are employed to connect the contact block 200 with the pivot block assembly 132, the bores 166 and 150 in the pivot block assembly 132 are preferably threaded. Also, with such a configuration, it would be unnecessary for the bores 166 and 150 to extend completely through block assembly 132. That is, it would be sufficient for the bores 166 and 150 to extend upward through the lower surface of block assembly 132 a sufficient distance so as to securely receive the screws 216. Alternatively, however, and as described in subsequent paragraphs herein, an additional interconnection arrangement can be employed whereby screws 260 (described in subsequent paragraphs herein) may extend completely through the block assembly 132. In such event, the bores 166 and 150 would extend through block assembly 132 and may be threaded or unthreaded.

Figure 6:
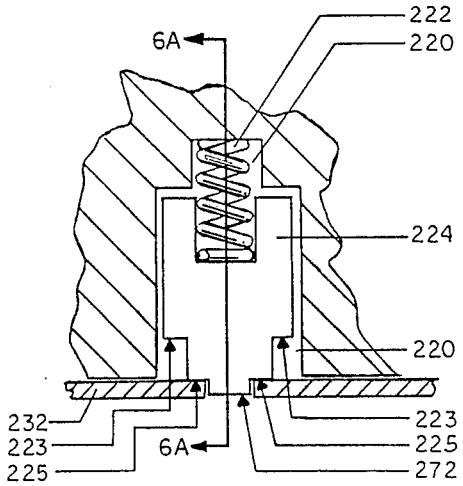
FIG. 6 is a partial sectional view showing an exemplary latch plug and spring arrangement for the pivotable power feed connector shown in FIG. 1 in accordance with the invention, taken along section lines 6—6 of FIG. 2.

As shown in FIGS. 2 and 6, the contact block 200 also includes a set of recesses 220 located on the side walls 206 of the rectangular slab 202. FIG. 2 shows two of the recesses 220 located in one of the side walls 206. Although not specifically shown in the drawings, additional recesses 220 are located in the opposing side wall 206, with the additional recesses 220 slightly offset from the recesses 220 specifically shown in FIG. 2. For purposes of engaging additional elements of the power feed connector 100 as described in subsequent paragraphs herein, a coil spring 222 and associated latch plug 224 are preferably received within a corresponding one of each of the recesses 220.

Figure 6A:
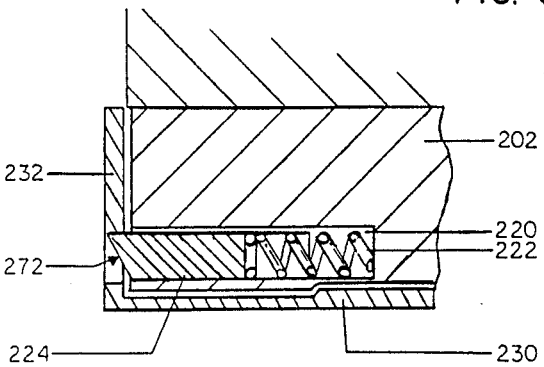
FIG. 6A is a further sectional view of the latch plug and spring arrangement shown in FIG. 6, taken along section lines 6A—6A of FIG. 6 and showing the beveled configuration of a terminating end of the plug.

Each of the latch plugs 224 can have a structural configuration substantially corresponding to that shown in FIGS. 6 and 6A, whereby the end of the latch plug 224 projecting outwardly from the recess 220 comprises a stepped configuration. The stepped configuration forms outer ledges 223, intermediate ledges 225 and a terminating end 272 in each latch plug 224. With each of the coil springs 222 and latch plugs 224 having the configuration shown in FIGS. 2 and 6, the coil springs 222 will act to exert forces so as to tend to push the latch plugs 224 outwardly in a lateral direction away from the side walls 206.

In addition to the foregoing, the rectangular slab 202 of the contact block 200 also includes a wedge-shaped ledge 226 projecting outwardly from each of the end walls 208. Only one of the wedge-shaped ledges 226 is shown in FIG. 2. The particular functions of the coil springs 222, latch plugs 224 and wedge-shaped ledges 226 will become apparent from subsequent description of the interconnection of various elements of the pivotable power feed connector 100 in subsequent paragraphs herein.

The pivotable power feed connector 100, as further shown primarily in FIG. 2, also includes a protective connector block cover 228. The block cover 228 includes a flat rectangular portion 230 with a pair of upwardly extending opposing side portions 232, and a pair of upwardly-extending parallel opposing end portions 234. The flat rectangular portion 230 includes a series of prong terminal slots 236 located in the rectangular portion 230 and in alignment with the prong terminals 212 of the contact block 200 when the cover 228 is secured to the block 200 as subsequently described herein. When the entirety of the pivotable power feed connector 100 is assembled and mounted into the receptacle 102 of the modular panel 104, the prong terminals 212 will extend through the prong terminal slots 236.

As shown in FIGS. 2 and 7, the upper surface of the flat rectangular portion 230 includes a series of four rounded bosses 238 positioned adjacent each of the four corners of the rectangular portion 230. Only one of the bosses 238 is shown in each of FIGS. 2 and 7. The bosses 238 are positioned so as to coincide with the counter-bored holes 214 when the protective cover 228 is secured to the contact block 200. In this manner, the bosses 238 provide a coupling support for the springs 218.

The protective cover 228 further includes a vertically disposed slot 240 centrally located in each of the opposing end portions 234 and opening upwardly therefrom as shown in FIG. 2. In addition, as shown primarily in FIGS. 2, 3 and 4, the cover 228 also includes a series of T-slots located in the opposing side portions 232. Each of the T-slots 242 is positioned so as to coincide with the position of a corresponding one of the recesses 220 in the contact block 200 when the protective cover 228 is secured to the block 200. Further, each of the T-slots 242 includes an upper first slot 244 and a lower elongated second slot 246 perpendicularly extending from the central portion of the first slot 244.

Finally, as shown in FIG. 2 and several of the other drawings, the power feed connector 100 preferably includes a power feed cover 248. The cover 248 includes two parallel opposing side portions 250, an interconnecting end portion 252 and an upper surface 254. As shown primarily in FIGS. 2, 3 and 4, the power feed cover 248 is configured so that the upper surface 254 is arcuate in shape and extends from the interconnecting end portion 252 downwardly toward the lower edges of the side portions 250. In this manner, the power feed cover 248 has somewhat of a wedge-shaped cross-sectional configuration.

Located in the interconnecting end portion 252 is a downwardly opening channel 256 having a curved upper portion sized so as to appropriately receive the conduit or cable 118 when the power feed connector 100 is assembled. In addition, a pair of holes 258 are located in the upper surface 254 of the cover 248. The holes 258 are preferably counter-bored from the top and adapted to receive corresponding ones of a pair of connecting screws 260. The holes 258 are appropriately positioned so as to be aligned with the bores 124 in the main body portion 122 of the pivotal connector 116 when the power feed connector 100 is assembled.

The assembly of the various elements of the power feed connector 100, and the interconnection of the power feed connector 100 with the connector receptacle 102 will now be described. Referring to FIG. 5, the pivot block assembly 132 can be assembled by coupling together the first half section 136 with the second half section 138 through the engagement of the pintles 152 on the first half section 136 with corresponding holes (not shown) on the second half section 138. It should be emphasized that the half sections are coupled together with the contact block boss 210 (FIG. 2) received within the cavity 186, so that the conductors 120 appropriately extend through assembly 132. Prior to engagement of the first and second half sections 136, 138, the lock tabs 168 will also be assembled into the pivot block assembly 132 by engaging the pintles 152 through the bores 172 of the projecting arms 170 of each lock tab 168.

Figure 3:
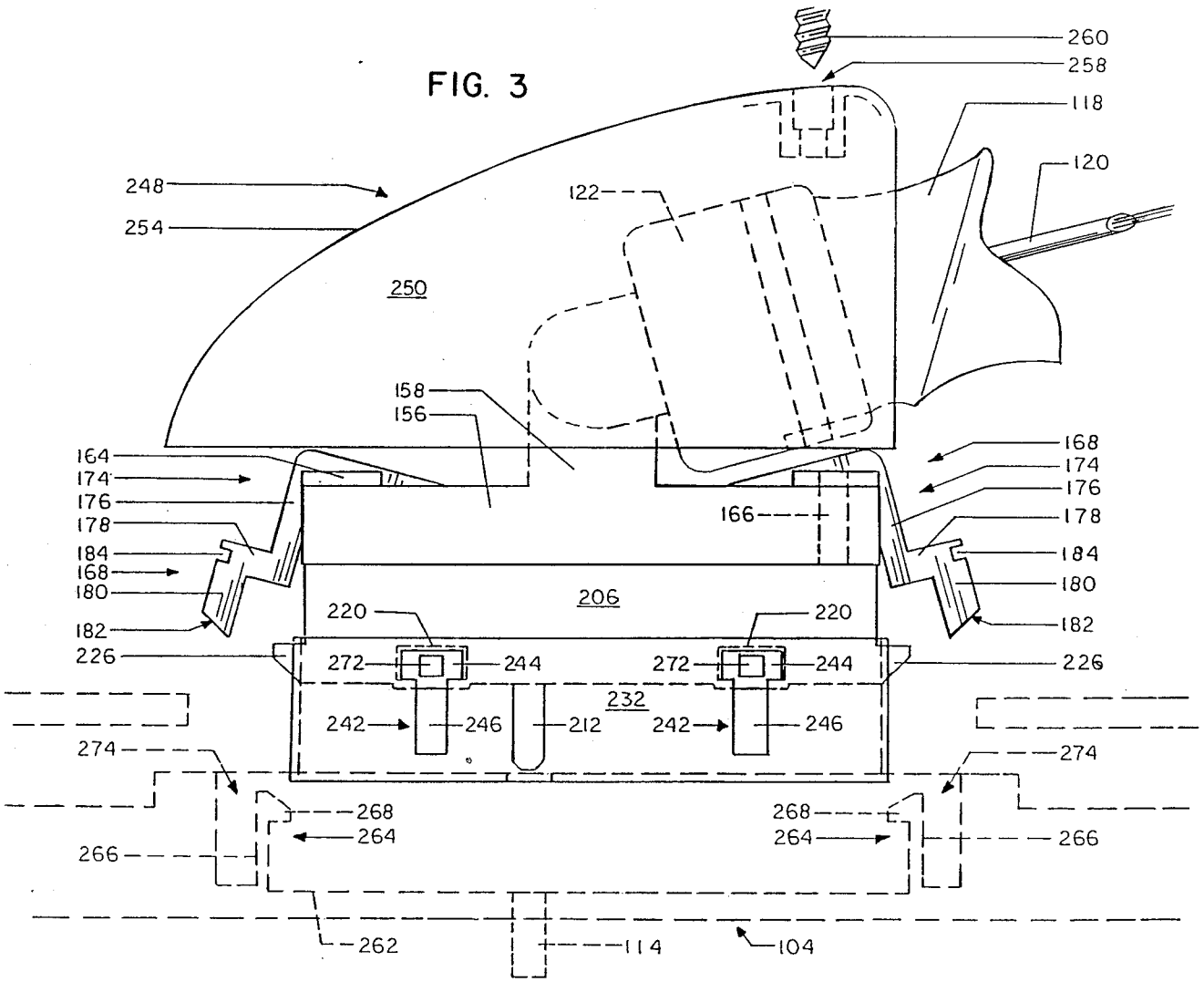
FIG. 3 is an elevation view of the pivotable power feed connector shown in FIG. 1 in accordance with the invention, with the protective cover in an extended position and the power feed connector initially engaging the connector receptacle.

The contact block 200 can be secured to the pivot block assembly 132 by means of the screws 216 being received upwardly through the holes 214 of contact block 200 and then threadably engaging corresponding holes in the pivot block assembly 132. During initial assembly, the lock tabs 168 will be in an "unlocked" position primarily as shown in FIG. 3. As previously described, with the contact block 200 connected to the pivot block assembly 132, the rectangular boss 210 on the upper surface 204 of the contact block 200 will be received within the cavity 186 of the pivot block assembly 132.

The pivotal connector 116, with the interconnected flexible conduit or cable 118, can then be coupled to the pivot block assembly 132 by means of engaging the trunnions 130 into the trunnion slots 144 through the flared openings 146. With this type of interconnection through the trunnions 130 and trunnion slots 144, it should be noted that the flexible conduit or cable 118 and interconnected pivotal connector 116 can be pivoted about the trunnions 130 and positioned in any of various directions of the flexible conduit or cable 118 relative to the pivot block assembly 132, by means of pivotal rotation of the pivotal connector 116 relative to the block assembly 132. In use, however, the pivotal connector 116 will preferably be coupled to the pivot block assembly 132 so that the flexible conduit or cable 118 extends directly toward one end of the block assembly 132, or the opposing end of the block assembly 132. In either of these configurations, one side of the main body portion 122 will be positioned substantially flush against the rectangular portions 140, 156 and rectangular ledges 148, 164 of the pivot block assembly 132.

After the foregoing assembly of the pivotal connector 116, pivot block assembly 132 and contact block 200 has been completed, the protective connector block cover 228 can be assembled to the contact block 200. Specifically, the protective cover 228 can be positioned adjacent the contact block 200 as shown in FIG. 2, and extended toward the underside portion of the contact block 200. First, however, the springs 218 should be appropriately positioned within the counterbored holes 214 of the contact block 200. In addition, each of the coil springs 222 and corresponding ones of the latch plugs 224, with their beveled ends facing downwardly (FIG. 6A) toward the flat rectangular portion 230, should be appropriately positioned within corresponding recesses 220 in the side walls 206 of the contact block 200.

As the protective connector block cover 228 is moved toward the contact block 200, the coil springs 218, positioned within the counter-bored holes 214, are received on the rounded bosses 238 located on the rectangular portion 230 of the cover 228. As the cover 228 is further moved toward the contact block 200, the side walls 206 and end walls 208 of contact block 200 are received within the interior area of the protective cover 228 formed by the opposing side portions 232 and opposing end portions 234. In addition, the wedgeshaped ledges 226, located on the end walls 208 of the contact block 200, are slidably received within the vertically disposed slots 240 located in the opposing end portions 234 of the cover 228.

As the protective cover 228 is further moved toward the contact block 200, the interior walls of the opposing side portions 232 will contact the beveled ends 272 of latch plugs 224. When contact is made, the latch plugs 224 and associated coil springs 222 will be compressed into the recesses 220 located in the side walls 206 of contact block 200. Compression of the latch plugs 224 and coil springs 222 will continue until the upper first slots 244 of the T-slots 242 in the opposing side portions 232 are aligned with the latch plugs 224 and recesses 220. Upon such alignment, the latch plugs 224, reacting to outwardly directed forces exerted by the coil springs 222, will "snap" into the corresponding ones of the upper first slots 244 of the T-slots 242. The latch plugs 224 will move outwardly from the recesses 220 until the latch plug ledges 223 abut the interior walls of the cover 228 adjacent the upper first slots 244. Accordingly, the intermediate latch plug ledges 225 will extend outwardly through the upper slots 244.

In this configuration, the protective cover 228 is secured to the contact block 200, but in such a manner that it is located in an "extended" position, whereby the metallic prong terminals 212 are within the interior of the cover 228, and thus cannot accidentally contact tools or an assembler/user. The cover 228 is prevented from further movement either toward or away from the contact block 200 by the extension of the latch plugs 224 partially through the upper slots 244 of T-slots 242. It should be noted that the width of each latch plug 224 along the intermediate ledges 225 is greater than the width of the lower second slots 246 of each T-slot 242, thus preventing movement of cover 228 toward contact block 200. It should also be noted that when the protective cover 228 and contact block 200 are in the relative configurations as described above, the coil springs 218, mounted within the counter-bored holes 214 of the contact block 200 and received on the rounded bosses 238 of the cover 228, act so as to exert forces so as to assist in maintaining the cover 228 in an extended position, thereby completely shielding the metallic prong terminals 212.

In accordance with one aspect of the invention, the latch plugs 224 cannot move through the lower second slots 246 of the T-slots 242 without first being pushed inwardly toward the recesses 220. The latch plugs 224 and T-slots 242 also comprise a design such that the protective cover 228 cannot be retracted toward the contact block 200 without "simultaneously" engaging all of the latch plugs 224 and pushing the same inward so that the latch plugs 224 can slidably move through the lower second slots 246 of the T-slots 242.

Figure 4:
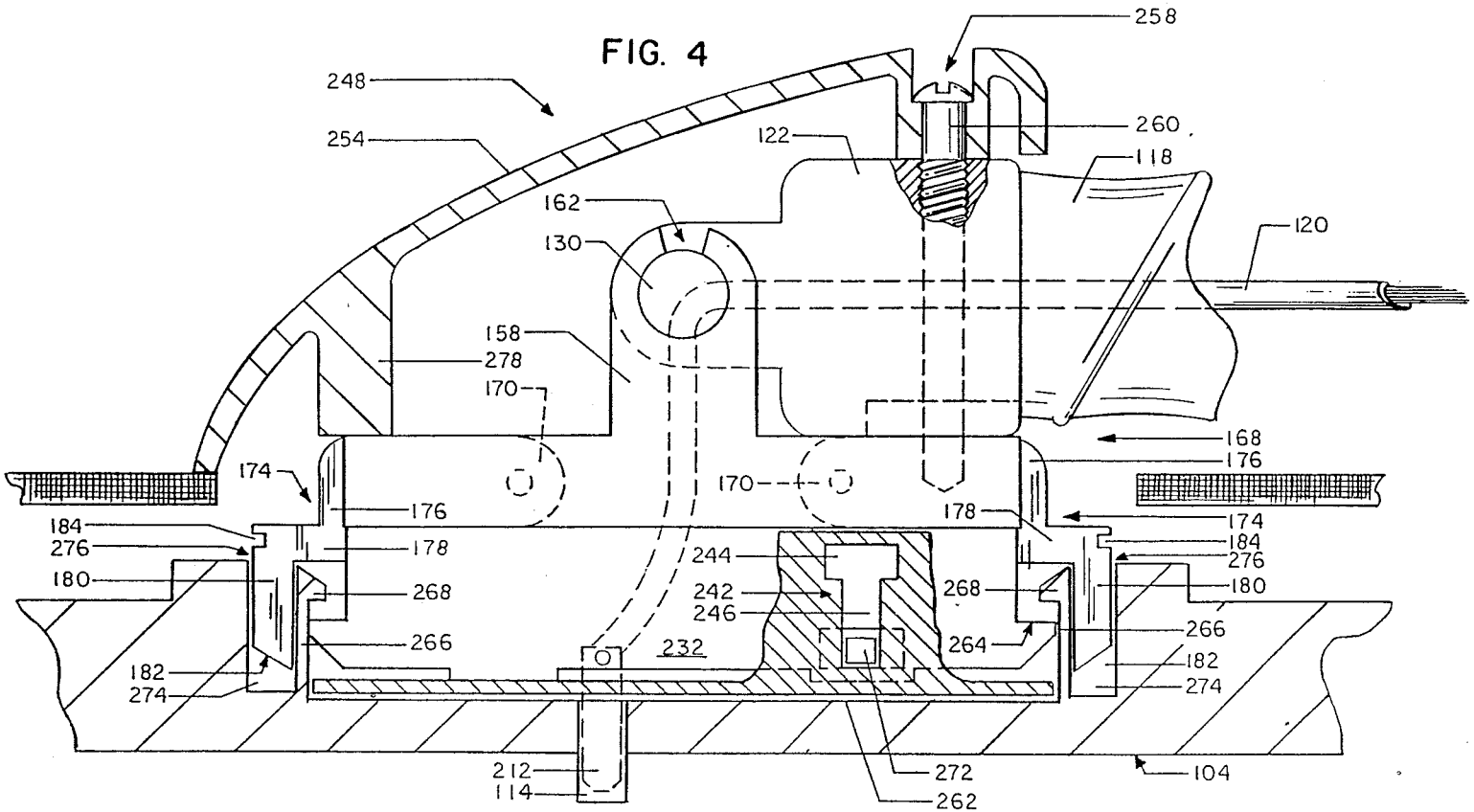
FIG. 4 is a sectional view, similar to FIG. 3, of the pivotable power feed connector shown in FIG. 1 in accordance with the invention, taken along section lines 4—4 of FIG. 2 and showing the power feed connector engaging the connector receptacle, with, the protective cover in a retracted position.

With the protective cover 228 assembled together with the contact block 200, pivot block assembly 132 and pivotal connector 116 as described in the foregoing paragraphs, the assembled portion of the power feed connector 100 can then be electrically interconnected with the connector receptacle 102. Referring primarily to FIGS. 1, 3 and 4, the connector receptacle 102 in the modular panel 104 includes a series of terminal slots 114 as previously described. The terminal slots 114 are located on a rear wall 262 of the connector receptacle 102. Also mounted to the rear wall 262 are a pair of receptacle spring tabs 264 having a structural configuration as primarily shown in FIGS. 3 and 4. Specifically, each of the spring tabs 264 includes an elongated portion 266 projecting outwardly from the rear wall 262. At the distal end of each of the elongated portions 266 is a tab retainer 268 having a structural configuration as also primarily shown in FIGS. 3 and 4. Each of the spring tabs 264 is configured so as to have some resiliency and flexibility for purposes of slight movement as described in subsequent paragraphs therein.

Referring again primarily to FIGS. 3 and 4, and with the protective cover 228 coupled to the contact block 200 as previously described, the assembled portions of the power feed connector 100 can then be moved toward the connector receptacle 102 in the configuration as generally shown in FIGS. 1 and 3. In this configuration, the lock tabs 168 are preferably "raised" to an upper position as shown in FIG. 3, so as to allow the assembled portion of the power feed connector 100 to engage the connector receptacle 102.

More specifically, as the assembled portion of the power feed connector 100 is moved into the connector receptacle 102, the tab retainers 268 will be resiliently pushed outwardly toward the sides of the connector receptacle 102 by the beveled wedge-shaped ledges 226 of the contact block 200. Correspondingly, as the protective cover 228 continues to move into engagement within the connector receptacle 102, the latch plugs 224 will contact the side walls 270 of the connector receptacle 102 (only one of the side walls 270 being shown in FIG. 1). Referring to FIGS. 3 and 6, the end surface 272 of each latch plug 224 preferably is beveled in a configuration similar to the beveled-shaped ledges 226 also shown in FIGS. 3 and 4. With this beveled-shaped configuration, as the terminating ends 272 of the latch plugs 224 contact the side walls 270 of receptacle 102, the latch plugs 224 are pushed inwardly in a direction opposing the force of the coil springs 222. As the latch plugs 224 are pushed inwardly in this manner, the protective cover 228 is allowed to retract toward the contact block 200, thus exposing the metallic prong terminals 212. However, it should be emphasized that exposure of the metallic prong terminals 212 does not occur until the interior chamber of the receptacle 102 is substantially enclosed by the position of the assembled portion of the power feed connector 100. Accordingly, the metallic prong terminals 212 still cannot be accidentally exposed to human touch or inadvertant contact with conductive tools or the like.

With the latch plugs 224 pushed inwardly and the protective cover 228 being retracted toward the contact block 200, the terminating ends 272 of the latch plugs 224 will move through the lower second slots 246 of the T-slots 242 toward the position shown in FIG. 4. Correspondingly, the metallic prong terminals 212 will be received within the terminal slots 114 of the connector receptacle 102. In addition, as the protective cover 228 retracts toward the contact block 200, and the contact block 200 moves forwardly toward the interior of the connector receptacle 102, the wedge-shaped ledges 226 on the contact block 200 will abut the tab retainers 26 of the receptacle spring tabs 264. Upon this abutting contact, the elongated portions 266 of the spring tabs 264 will flex outwardly and allow the ledges 226 to move past the tab retainers 268. After the ledges 226 move past the tab retainers 268, the elongated portions 266 of the spring tabs 264 will return to their normal position, whereby the tab retainers 268 will "snap over" the wedge-shaped ledges 226. With this configuration, as specifically shown in FIG. 4, the assembled portion of the power feed connector 100, and in particular the pivot block assembly 132, contact block 200 and protective cover 228, are substantially "locked" into interconnection with the connector receptacle 102. That is, if the assembled portion of the power feed connector 100 were pulled outwardly from the receptacle 102, the tab retainers 268 would preventably abut the upper surfaces of the wedge-shaped ledges 226, thereby preventing further movement.

After the assembled portion of the power feed connector 100 has been locked into the connector receptacle 102 as described in the foregoing paragraphs, additional locking capacity can be achieved by pivoting each of the lock tabs 168 downwardly so that the finger portions 174 of the lock tabs 168 are located in cavities 274 formed between end walls of the receptacle 102 and the receptacle spring tabs 264. This additional locking capacity provided by the lock tabs 168 prevents any substantial lateral movement of the assembled portion of the power feed connector 100 relative to the receptacle 102. In particular, this additional locking capacity will substantially reduce the possibility of shock resulting from partial disengagement of the power feed connector 100 from the receptacle 102.

To disengage the power feed connector 100 from the connector receptacle 102, a screw driver blade or similar wedge-shaped device can be positioned between side walls of the connector receptacle 102 and the slot 184 in each of the lock tabs 168. The position of such placement is shown in FIG. 4 as positions 276. Forces can then be exerted on the screw driver blade or other similar device so as to wedge the locking tabs 168 outwardly and upwardly from the cavities 274. After the lock tabs 168 have been removed from the cavities 274, the receptacle spring tabs 264 can be flexed outwardly toward the end walls of the receptacle 102 by inserting a screw driver blade or similar device between the tab retainers 268 and the end walls 23 of the cover 228. The assembled contact block 200 can then be pulled outwardly. As the contact block 200 is moved outwardly, wedge-sdhaped ledges 226 of contact block 200 will clear the tab retainers 268 of receptacle 102 and the terminating ends 272 of the latch plugs 224 will move in the lower second slots 246 of the T-slots 242 until the latch plugs 224 engage the upper first slots 244 of the T-slots 242. Upon such engagement, it should be emphasized that the metallic prong terminals 212 on the contact block 200 will again be shielded by the position of the protective cover 228. Further, this shielding effect will occur prior to the contact block 200 being moved away from the interior of the receptacle 102 a sufficient distance so as to accidentally expose an assembler or others to contact with the prong terminals 212.

After the latch plugs 224 have been moved into engagement with the upper first slots 244 of the T-slots 242, the contact block 200 and protective cover 228 will move in unison outwardly from the receptacle 102. It should be emphasized that the forces exerted by the coil springs 218 positioned intermediate the rectangular portion 230 of the protective cover 228 and the bottom surface of the contact block 200 will act so as to insure that the protective cover 228 moves away from the contact block 200 during disengagement from the receptacle 102. It is the forces exerted by each of these springs 218 which ensure that the terminating ends 272 of the latch plugs 224 will move from the lower second slots 246 to the upper first slots 244 of the T-slots 242, thus shielding the metallic prong terminals 212 within the protective cover 228.

Returning again to the position of the assembled portions of the power feed connector 100 being appropriately secured to the connector receptacle 102 so as to engage the metallic prong terminals 212 within the terminal slots 114, the pivotal connector 116 can then be appropriately positioned as desired. As earlier described, this position can preferably be one where the flexible conduit or cable 118 extends in one particular direction relative to the end portions of the pivot block assembly 132, or can alternatively be positioned so that the flexible conduit or cable 118 extends in an opposing direction. When the pivotal connector 116 is positioned as desired, the power feed cover 248 can be secured over the pivotal connector 116 and interconnected by means of the screws 260 extending through the holes 258 and threadably engaging the bores 124 in the pivotal connector 116. For purposes of ensuring proper connection, it is possible for the power feed cover 248 to include a "locater" 278 as shown in FIG. 1 and as positioned on one side of the interior portion of the power feed cover 248. This locater 278 can engage a slot, indentation or similar means on the pivot block assembly 132 for purposes of ensuring that the power feed cover 248 is positioned in a proper orientation.

In accordance with the invention, it should be emphasized that to orient the flexible conduit or cable 118 and pivotable connector 116 in a different orientation, the screws 260 can be removed from the cover 248, the cover 248 can then be removed from the position of covering the pivotal connector 116 and pivot block assembly 132, and the conduit or cable 118 and pivotal connector 116 can then be rotated relative to the pivot block assembly 132 through an axis extending through the trunnions 130. This rotation can be performed so as to orient the flexible conduit or cable 118 in an opposing direction. To then cover the pivotal connector 116 and pivot block assembly 132, the power feed cover 248 need only be rotated 180° about an axis extending perpendicularly through a horizontal plane of the pivot block assembly 132. The screws 260 can then be inserted through the power feed cover 248 and into the bores 124 of the pivotal connector 116.

With the pivotable power feed connector 100 in accordance with the invention, another significant advantage can be achieved with respect to installation of the power feed connector 100 into the receptacle 102. Specifically, it is possible for the original components of the power feed connector 100, including the flexible conduit or cable 118, to be originally manufactured in standard lengths. At the end of the conduit or cable 118 opposing the end connected to the pivotal connector 116, a conventional conduit fitting (not shown) can be connected to the conduit end. Unfortunately, when installing the pivotable power feed connector 100, it is often desirable to utilize lengths of the conduit or cable 118 which do not conform to the standard commercially manufactured lengths.

The power feed connector 100 in accordance with the invention provides a means for facilitating the measuring and cutting of the conduit or cable 118 to an appropriate length. Specifically, prior to connecting the power feed cover 248 to the pivotal connector 116, the pivotal connector 116 can be pivoted about its axis extending through the trunnions 13 pivotably mounted in the trunnion holes 144 so that the flexible conduit or cable 118 extends perpendicularly relative to the horizontal plane of the central body section 134 of the pivot block assembly 132. The pivotal connector 116 can then be removed from the pivot block assembly 132 by exerting a pulling force sufficient so as to cause the trunnions 130 to be removed from the trunnion holes 144 through the flared openings 146. As specifically shown in FIG. 8, the pivotal connector 116 can then be pulled away from the pivot block assembly 132 a sufficient distance so as to extend the flexible conduit or cable 118 beyond the lengths of the conductors 120. The conduit or cable 118 can then be readily cut to a desired length. After the conduit or cable 118 is cut to the appropriate length, the pivotal connector 116 can then be easily reconnected to the pivot block assembly 132 by engaging the trunnions 130 into the trunnion holes 144 through the flared openings 146. The conduit fittings can then be reinstalled to the terminating end of the length of the conduit cable 118 to be utilized. Following this procedure, the power feed cover 248 can be appropriately installed and connected to the pivotal connector 116.

A number of the significant features of the power feed connector 100 in accordance with the invention are apparent from the foregoing description. In particular, the power feed connector 100 in accordance with the invention provides a substantial safety feature so as to prevent the assembler from coming into contact with "live" metallic prong terminals 212. In addition, during both assembly and disassembly of the power feed connector 100 from the connector receptacle 102, the metallic prong terminals 212 are appropriately shielded so that the assembler will not come into direct physical contact with live prong terminals, and it is substantially impossible for the assembler to accidentally contact the live prong terminals with conductive tools.

In accordance with another aspect of the power feed connector 100 in accordance with the invention, it should be noted that the depth of the modular panel 102 can be of various dimensions, without necessitating different sizes of the power feed connector 100. That is, the depth of the modular panel receptacle can be varied to meet varying degrees of panel depth, and the power feed connector 100 will still accommodate some variations in depth.

Still further, it should also be noted that the screws 260 extending through the power feed cover 248 are of sufficient length so as to be received within the bores 124 of the pivotal connector 116. If the screws 260 terminate within the pivotal connector 116, the bores 124 are preferably threaded. In addition, however, the screws 260 can be of a sufficient length so as to extend completely through the pivotal connector bores 124 and threadably engage the bores 150 and 166 within pivot block assembly 132. In this manner, a secure connection is provided between the pivotal connector 116 and assembly 132.

Still further, an additional locking arrangement could be provided by including additional holes in the protective cover 228 in alignment with the counter-bored holes 258 of the power feed cover 248. Also, holes could be threadably bored into the rear wall 262 of the connector receptacle 102, and the screws 260 could be of a sufficient length so as to extend completely through aligned holes in the pivotal connector 116, pivot block assembly 132, contact block 200 and protective cover 228 so as to engage holes in the rear wall 262 of the connector receptacle 102. Such an arrangement provides an even more secure locking mechanism for the entirety of the elements of the power feed connector 100.

In addition to the previously described features of the power feed connector 100, it is also possible to include elements associated with the protective cover 228 or contact block 200 in association with the connector receptacle 102, so as to ensure that the pivotable power feed connector 100 is appropriately oriented when engaged with the connector receptacle 102. For example, a key slot 280 in the form of a slot, channel or similar indentation or recess can extend along one of the side walls 232 or end walls 234 of the protective cover 228. For example, such a slot 280 is shown in one end walls 234 of cover 228 in FIGS. 1 and 2. A corresponding key 282 in the form of a lip, tab or other protrusion can be provided within a side or end wall of the connector receptacle 102. For example, such a key 282 is shown in FIG. 1. This connector receptacle key 282 would be positioned so as to be appropriately aligned with the slot 280 on the protective cover 228 so that the key 282 would be received within the slot 280 when the power feed connector 100 was appropriately aligned with the connector receptacle 102. In the event of misalignment, the key 282 and key slot 280 on the protective cover 228 would prevent the protective cover 228 from being inserted within the interior of the connector receptacle 102. With the foregoing functional advantage in mind, it is apparent that the key/slot configuration could be reversed, with the key located on the cover 228, and the key slot located on the receptacle 102.

Figure 10:
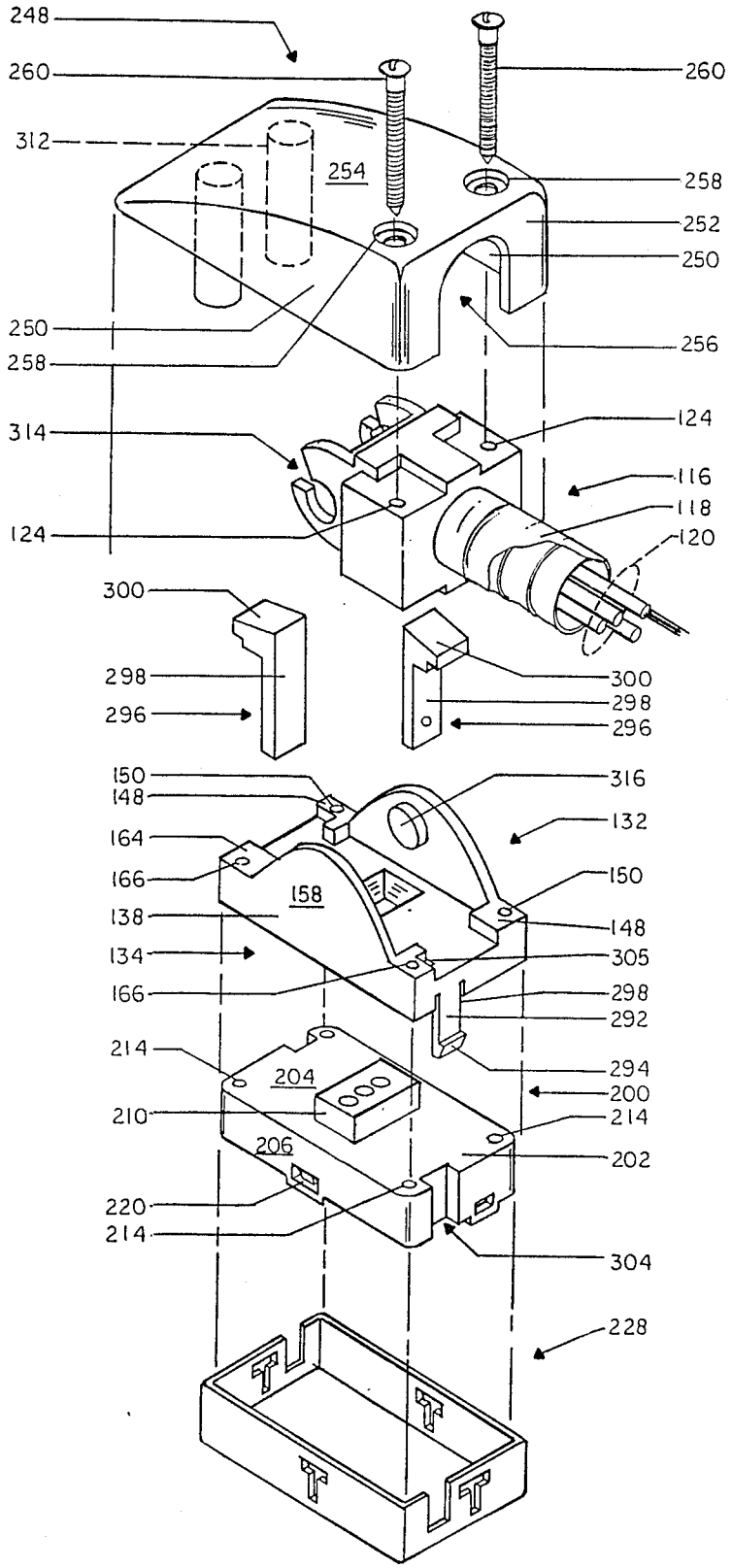
FIG. 10 is a simplified exploded perspective view of a modified version of the pivotable power feed connector shown in FIG. 1 in accordance with the invention, showing a modified locking arrangement between the power feed connector and the connector receptacle.
Figure 11:
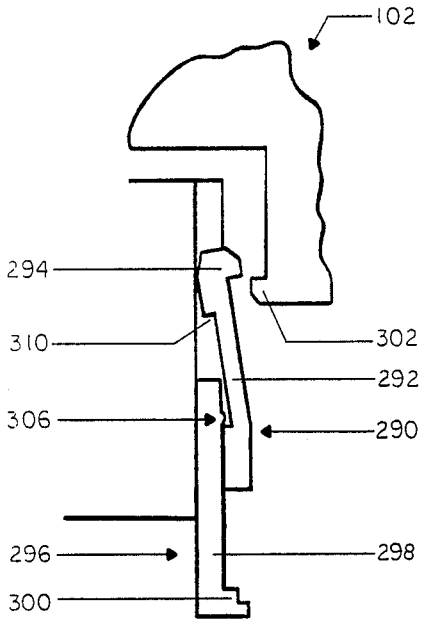
FIG. 11 is a sectional view showing a partial illustration of the locking arrangement between the power feed connector and the connector receptacle, with the power feed connector in an "unlocked" position.
Figure 12:
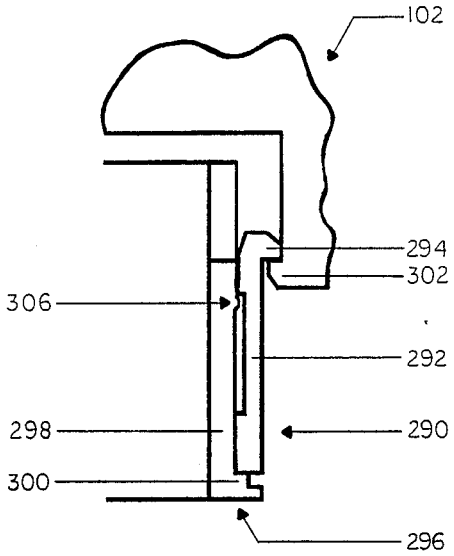
FIG. 12 is a partial sectional view similar to FIG. 11, but showing the power feed connector in a "locked" position.

FIGS. 10, 11 and 12 illustrate a slightly modified version of a power feed connector arrangement in accordance with the invention, with the modified version including modifications for "locking" the power feed connector 100 to the connector receptacle 102. As described with respect to FIGS. 1, 3 and 4, the connector receptacle 102 and the modular panel 104 includes a series of terminal slots 114. The slots 114 are located on a rear wall 262 of the connector receptacle 102. Also mounted to the rear wall 262 are a pair of receptacle spring tabs 264 having a structural configuration primarily shown in FIGS. 3 and 4. Specifically, the spring tabs 264 include an elongated portion 266 projecting outwardly from the rear wall 262. At the distal end of each of the elongated portions 266 is a tab retainer 268 having a structural configuration as also primarily shown in FIGS. 3 and 4 Each of the spring tabs 264 is configured so as to have some resiliency and flexibility for purposes of slight movement as previously described herein.

With the protective cover 228 coupled to the contact block 200 as previously described, the assembled portions of the connector 100 can then be moved toward the connector receptacle 102 in the configuration as generally shown in FIGS. 1 and 3. The lock tabs 168 are preferablly "raised" to an upper position as shown in FIG. 3, so as to allow the assembled portion of the connector 100 to engage the connector receptacle 102.

As the assembled portion of the connector 100 is moved into the receptacle 102, the retainers 268 are resiliently pushed outwardly toward the sides of the connector receptacle 102 by the beveled wedge-shaped ledges 226 of the contact block 200. Upon this abutting contact, the elongated portions 266 of tabs 264 flex outwardly and allow the ledges 226 to move past the tab retainers 268. After the ledges 226 move past the tab retainers 268, the elongated portions 266 of the tabs 264 return to their normal position, whereby the retainers 268 will "snap over" the ledges 226. With this configuration, as shown in FIG. 4, the assembled portion of the power feed connector 100, and in particular the pivot block assembly 132, contact block 200 and cover 228 are substantially "locked" into interconnection with the receptacle 102. That is, the retainers 268 preventably abut the upper surfaces of the ledges 226, thereby preventing any further movement.

In the arrangement illustrated in FIGS. 10, 11 and 12, the pivot block assembly 132 is provided with a pair of locking clips 290 (only one of which is shown in FIGS. 10, 11 and 12) on each side wall of the assembly 132. Each of the locking clips 290 includes an elongated portion 292 and a distal tab 294. Correspondingly, the power feed connector 100 also includes a pair of lock elements 296, each of the lock elements 296 having an elongated portion 298 and a distal tab portion 300. Further, on each side of the connector receptacle 102 is a "hook" portion 302. Each of the locking clips 290 is located so as to be extended through a slot 304 associated with the contact block 200. As illustrated primarily in FIGS. 11 and 12, each of the lock elements 296 includes a small "bump" 306. Each of the block elements 296 extends through a slot 308 formed in the pivot block assembly 132, and further through the slot 304 of the contact block 200.

When each of the locking clips 290 is depressed, as illustrated in FIG. 11, the power feed connector 100 can be removed from its extended position into the connector receptacle 102. However, if the lock elements 296 are extended through the slots 304 and 306, and primarily fully extended as illustrated in FIG. 12, the locking clips 290 are prevented from being depressed inwardly. With the locking clips 290 being prevented from being depressed inwardly, the distal tab 294 of each of the locking clips 290 is prevented from being moved past the hook portions 302 of the connector receptacle 102. In this manner, the power feed connector 100 is prevented from being removed from the connector receptacle 102.

However, if the lock elements 296 are withdrawn, the locking clips 290 can be depressed (as illustrated in FIG. 11) and the power feed connector 100 removed from the connector receptacle 102. The "bumps" 306 are utilized to prevent the lock elements 296 from being removed from the power feed connector 100 assembly. Further, each of the locking clips 290 includes a notch 310 which prevents the lock elements 296 from extending inwardly, if the locking clips 290 are not fully "seated" within the hook portions 302.

It should be emphasized that the arrangement illustrated in FIGS. 10, 11 and 12 is merely a modified version of a locking arrangement for the power feed connector 100 in accordance with the invention. It should also be emphasized that elements similar in structure and function to the elements illustrated in FIGS. 1–9 utilize the same numerical references within the FIGS. 10, 11 and 12. Further, it should be noted that the lower surface of the pivot block assembly 132 will abut the top of the first lock element 296 when the lock element 296 is positioned within the assembly. The second lock element 296 (not shown in FIG. 10) ca be seated on a pin 312 mounted underneath the power feed cover 248.

Figure 13:
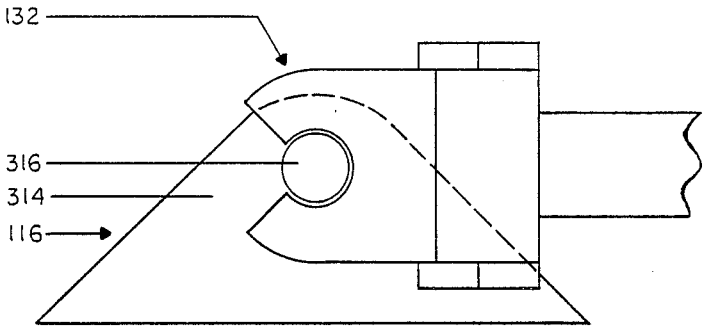
FIG. 13 is a partial sectional view of a modified version of a trunnion interconnection between the pivotal connector and the pivot block assembly.

As primarily illustrated in FIG. 2, and previously described herein, the pivotal connector 116 includes a pair of trunnions 130. Correspondingly, trunnion slots 160 are also provided within the pivot block assembly 132. In a slightly modified version as shown i an extremely simplified form in FIG. 13, the trunnion assembly can be reversed. That is, as illustrated in FIGS. 10 and 13, the pivot block assembly 132 can include a pair of trunnion slots 314 adapted to receive trunnions 316 associated with the pivotal connector 116. FIG. 13 illustrates only primary elements and partial configurations of the pivotal connector 116 and the pivot block assembly 132. This reversal of the trunnion design, relative to the design illustrated in FIG. 2, appears to provide some improvement of performance. More specifically, it has been found that with the reverse trunnion design, relative to the design illustrated in FIG. 2, the trunnions 316 do not appear to have a tendency to "snap off" the trunnion pivots 314 during assembly.

It will be apparent to those skilled in the pertinent art that other embodiments of pivotable power feed connectors in accordance with the invention can be designed. For example, other specific locking arrangements for providing interconnections between the contact block 200, protective cover 228 and connector receptacle 102 can be provided without departing from the broader principles of the invention. That is, the principles of a pivotable power feed connector in accordance with the invention are not limited to the specific embodiment described herein. It will be apparent to those skilled in the art that modifications and other variations of the abovedescribed illustrative embodiment of the invention may be effective without departing from the spirit and scope of the novel concepts of the invention.

The embodiments of the invention in which an exclusive property or privilege is claimed are defined as follows:

1. A power feed assembly adapted to supply electrical power and/or ground voltages to an electrical receptacle means, said electrical receptacle means adapted to be located in or on a wall panel or support surface or the like, and connectable to various types of electrical apparatus or to other receptacle means, said power feed assembly comprising:

pivotal connector means adapted to be secured to a conduit or cable having at least one conductor capable of carrying electrical power or ground voltage prior to any electrical connection to said electrical receptacle means;

pivot block means pivotably connectable to said pivotal connector means for providing a pivot connection relative to said conduit or cable;

contact block means connectable to said pivot block means and having at least one prong terminal electrically connectable to said at least one conductor;

protective cover means adapted to be slidably secured to said contact block means for selectively covering said at least one prong terminal; and means for selectively locking said pivotal connector means in a fixed position relative to said pivot block means.

2. A power feed assembly in accordance with claim 1 characterized in that:

said pivotal connector means comprises first pivot means for pivotably connecting said pivotal connector means to said pivot block means;

said pivot block means comprises second pivot means connected to said first pivot means for pivotably connecting said pivot block means to said pivotal connector means; and said first pivot means is interconnectable with said second pivot means in a manner so as to allow said conduit or cable to freely swivel throughout a range of at least approximately 180° relative to said pivot block means.

3. A power feed assembly in accordance with claim 2 characterized in that:

said first pivot means comprises at least one pair of trunnions; and said second pivot means comprises at least one pair of connecting standards, each of said standards having means for pivotably receiving one of said at least one pair of trunnions.

4. A power feed assembly in accordance with claim 1 characterized in that:

said pivotal connector means comprises first interconnection means for removably interconnecting said pivotal connector means with said pivot block means;

said pivot block means comprises second interconnection means removably connectable to said pivotal connector means for removably interconnecting said pivot block means with said pivotal connector means; and said conduit or cable is secured to said pivotal connector means and said first interconnection means is interconnectable with said second interconnection means so that said pivotal connector means is manually removable from said pivot block means independent of requiring the use of tools or the like, so that said conduit or cable can be pulled back from said pivot block means independent of and relative to said at least one conductor for purposes of modifying the length of said conduit or cable.

5. A power feed assembly in accordance with claim 4 characterized in that said first interconnection means is removably snap-fitted into said second interconnection means.

6. A power feed assembly in accordance with claim 4 characterized in that:

said first interconnection means comprises a pair of flanges, each of said flanges having a trunnion mounted thereon; and said second interconnection means comprises a pair of connecting standards, each of said standards having a trunnion hole and an opening extending outwardly from said trunnion hole, so that each of said trunnions can be snap-fitted into and manually removed from one of said trunnion holes through a corresponding one of said openings.

7. A power feed assembly in accordance with claim 1 characterized in that said assembly further comprises latching means associated with said contact block means and said protective cover means, and adapted to removably latch said protective cover means in a first position relative to said contact block means as said protective cover means is first slidably engaged onto said contact block means, whereby said protective cover means shields said at least one prong terminal when in said first position 8. A power feed assembly in accordance with claim 7 characterized in that said latching means is configured so as to automatically unlatch said protective cover means from said first position as said power feed assembly physically engages said electrical receptacle means, and allow said protective cover means to move to a second position relative to said contact block means, whereby said at least one prong terminal is exposed and electrically connectable to said receptacle means.

9. A power feed assembly in accordance with claim 8 characterized in that said latching means comprises:

a plurality of recesses located in said contact block means and opening laterally outwardly therefrom;

slot means located in said protective cover means; and resilient plug means resiliently positioned in said plurality of recesses and adapted to engage said slot means as said protective cover means is slidably received onto said contact block means.

10. A power feed assembly in accordance with claim 9 characterized in that:

said slot means comprises a plurality of T-shaped slots, each of said T-shaped slots having a first slot and an elongated second slot perpendicular to said first slot; and said resilient plug means comprises a plurality of latch plugs corresponding in number to the number of said slots, said latch plugs adapted to lockably engage said first slots of said T-shaped slots when said protective cover means is in said first position, and said latch plugs are adapted to slidably engage said second slots of said T-shaped slots when said protective cover means is in said second position.

11. A power feed assembly in accordance with claim 10 characterized in that said latch plugs are resiliently positioned in said recesses so that when said latch plugs are engaged with said first slots of said T-shaped slots, and said protective cover means is in said first position, all of said latch plugs must be simultaneously compressed toward said recesses so as to disengage said protective cover means from said first position and move said protective cover means toward said second position.

12. A power feed assembly in accordance with claim 10 characterized in that said latch plug means further comprises spring means for resiliently urging outwardly each of said latch plugs from said recesses.

13. A power feed assembly in accordance with claim 10 characterized in that each of said latch plugs comprises a stepped end having outer ledges adapted to abut side walls adjacent said first slot of said T-shaped slot when said protective cover means is in said first position, intermediate ledges adapted to abut side walls adjacent said second slots of said T-shaped slots when said protective cover means is in said second position, and a terminating end extending outwardly between said intermediate ledges and adapted to be received in said second slot of said T-shaped slot when said protective cover means is moved from said first position to said second position.

14. A power feed assembly in accordance with claim 13 characterized in that said terminating end of each of said latch plugs is beveled so as to cause each of said plugs to compress inwardly toward said recesses when said protective cover means engages said receptacle means.

15. A power feed assembly in accordance with claim 8 characterized in that said assembly further comprises resilient means disposed between said contact block means and said protective cover means for exerting forces on said protective cover means tending to urge said protective cover means toward said first position.

16. A power feed assembly in accordance with claim 1 characterized in that said contact block means comprises locking wedge means for removably locking said power feed assembly into said receptacle means.

17. A power feed assembly in accordance with claim 1 characterized in that said electrical receptacle means comprises retainer means for removably retaining said power feed assembly within said receptacle means.

18. A power feed assembly in accordance with claim 1 characterized in that said pivot block means comprises lock tab means engageable with said receptacle means for removably locking said power feed assembly into said receptacle means.

19. A power feed assembly in accordance with claim 18 characterized in that said electrical receptacle means comprises cavities adapted to receive said lock tab means for locking said power feed assembly into said receptacle means.

20. A power feed assembly in accordance with claim 1 characterized in that:

said contact block means comprises locking wedge means extending outwardly from said contact block means for removably locking said power feed assembly into said electrical receptacle means; and said electrical receptacle means comprises retainer means having a shape and resiliency so as to flex sufficiently to allow said locking wedge means to p;@ss by said retainer means as said power feed assembly engages said electrical receptacle means, and further having a shape so as to prevent outward movement of said power feed assembly from said electrical receptacle means in the absence of any manual flexure of said retainer means.

21. A power feed assembly in accordance with claim 20 characterized in that said locking wedge means comprises a pair of wedge-shaped tabs each having a lower beveled face.

22. A power feed assembly in accordance with claim 20 characterized in that said retainer means comprises a pair of spring tabs, each of said spring tabs having a resilient elongated portion terminating in a retainer lip having an upper beveled face.

23. A power feed assembly in accordance with claim 20 characterized in that:

said pivot block means comprises a pair of lock tabs pivotable relative to said pivot block means; and said electrical receptacle means comprises a pair of cavities formed between side walls of said electrical receptacle means and said retainer means, with each of said cavities adapted to receive one of said lock tabs.

24. A power feed assembly in accordance with claim 1 characterized in that said pivotal connector means comprises:

a main portion through which said at least one conductor is extended;

a pair of extending flanges connected to outer sides of said main portion; and means associated with each of said flanges for allowing pivotal movement of said pivotable connector means relative to other elements of said power feed assembly.

25. A power feed assembly in accordance with claim 1 characterized in that said pivot block means comprises:

a flat rectangular portion;

a pair of connector standards extending upwardly from said rectangular portion; and means associated with each connector standard for receiving trunnions of said pivotal connector means for according pivotal movement of said connector means relative to said pivot block means.

26. A power feed assembly in accordance with claim 1 characterized in that said contact block means comprises:

a set of metallic prong terminals extending downwardly from an underside portion of said contact block means;

a plurality of recesses positioned at various locations on side walls of said contact block means; and a pair of wedge-shaped locking wedges extending outwardly from opposing end walls of said contact block means.

27. A power feed assembly in accordance with claim 1 characterized in that said protective cover means comprises:

a flat rectangular portion having a pair of upwardly-extending opposing side portions and a pair of upwardly-extending opposing end portions;

a plurality of prong terminal slots located in said flat rectangular portion;

a plurality of T-shaped slots located in said opposing side portions; and a pair of slots centrally located in said opposing end portions.

28. A power feed assembly in accordance with claim 1 characterized in that said means for selectively locking said pivotal connector means in a fixed position relative to said pivot block means comprises a cover having means for securing said cover to said pivotal connector means, whereby said cover is securable to said pivotal connector means with said pivotal connector means being in either of two fixed positions relative to said pivot block means.

29. A power feed assembly in accordance with claim 1 characterized in that said assembly further comprises:

first screw means for securing said contact block means to said pivot block means; and second screw means for securing said means for selectively locking said pivotal connector means in a fixed position relative to said pivot block means to said pivotal connector means.

30. A power feed assembly in accordance with claim 1 characterized in that said assembly further comprises key means associated with said protective cover means for preventing said power feed assembly from engaging said electrical receptacle means in any more than one spatial configuration relative to said electrical receptacle means.

31. A power feed assembly in accordance with claim 1 characterized in that said pivotal connector means includes a pair of trunnions, and said pivot block means includes a pair of trunnion pivots adapted to receive said trunnions.

32. A power feed assembly adapted to supply electrical power and/or ground voltages to an electrical receptacle means, said electrical receptacle means adapted to be located in or on a wall panel or support surface, and connectable to various types of electrical apparatus or to other receptacle means, said power feed assembly comprising:

a pivotal connector secured to a conduit or cable having a series of electrical conductors extending therethrough;

first pivot means mounted to said pivotal connector for providing a pivotable interconnection of said pivotal connector with other elements of said power feed assembly;

a pivot block connected to said pivotal connector and having a cavity through which said electrical conductors are received;

second pivot means connected to said first pivot means for providing a pivotable interconnection of said pivot block with said pivotal connector so as to allow said conduit or cable to freely pivot throughout an arc of at least approximately 180° relative to said pivot block;

a contact block having a series of conductive prong terminals extending downwardly from an underside portion of said contact block, and means for electrically interconnecting said conductors to said prong terminals; and a protective cover slidably engaged with said contact block and having a series of prong terminal slots aligned with said prong terminals.

33. A power feed assembly in accordance with claim 32 characterized in that said power feed assembly further comprises:

a plurality of recesses located in side walls of said contact block;

a plurality of latch plugs resiliently positioned in said recesses;

first slot means located in side walls of said protective cover and adapted to lockably engage said latch plugs when said protective cover is in a first position shielding said prong terminals; and second slot means located in said side walls of said protective cover and adapted to engage said latch plugs when said protective cover is in a second position, whereby said prong terminals extend through said prong terminal slots.

34. A power feed assembly in accordance with claim 32 characterized in that said power feed assembly further comprises:

a pair of lock tabs pivotably coupled to said pivot block and adapted to engage cavities in said electrical receptacle means to removably block said power feed assembly into engagement with said receptacle means; and a pair of locking wedges extending outwardly from end walls of said contact block to removably lock said power feed assembly into engagement with said receptacle means.

35. A power feed assembly in accordance with claim 32 characterized in that said power feed assembly further comprises means for selectively locking said pivotal connector in a fixed position relative to said pivot block.

* * * * *

UNITED STATES PATENT AND TRADEMARK OFFICE

CERTIFICATE OF CORRECTION

PATENT NO. :4,959,021

DATED :SEP 25, 1990

INVENTOR(S) :NORMAN R. BYRNE

It is certified that error appears in the above-identified patent and that said Letters Patent is hereby corrected as shown below:

Col. 28, claim 7, line 10, after "position" insert --.--.

Col. 32, claim 34, line 25, "block" should be --lock--.

Signed and Sealed this

Thirtieth Day of June, 1992

*Attest:*

DOUGLAS B. COMER

*Attesting Officer*

*Acting Commissioner of Patents and Trademarks*